US007209083B2

(12) United States Patent
Fujishima et al.

(10) Patent No.: US 7,209,083 B2
(45) Date of Patent: Apr. 24, 2007

(54) RADIO-FREQUENCY DEVICE

(75) Inventors: Tomoyasu Fujishima, Osaka (JP); Kazuyuki Sakiyama, Osaka (JP); Ushio Sangawa, Nara (JP); Hiroshi Kanno, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/392,642

(22) Filed: Mar. 30, 2006

(65) Prior Publication Data

US 2006/0164309 A1 Jul. 27, 2006

Related U.S. Application Data

(63) Continuation of application No. PCT/JP2005/012490, filed on Jul. 6, 2005.

(30) Foreign Application Priority Data

Jul. 7, 2004 (JP) ..... 2004-200307

(51) Int. Cl.
*H01Q 1/38* (2006.01)
*H01Q 1/48* (2006.01)

(52) U.S. Cl. ..... 343/700 MS; 343/847

(58) Field of Classification Search ..... 343/700 MS, 343/846, 847

See application file for complete search history.

(56) References Cited

U.S. PATENT DOCUMENTS 5,917,458 A * 6/1999 Ho et al. ..... 343/909
6,198,438 B1 3/2001 Herd et al.
6,218,978 B1 * 4/2001 Simpkin et al. ..... 342/5
6,323,809 B1 11/2001 Maloney et al.
6,476,771 B1 * 11/2002 McKinzie, III ..... 343/756
6,483,480 B1 * 11/2002 Sievenpiper et al. ..... 343/909
6,577,211 B1 6/2003 Tsujiguchi

FOREIGN PATENT DOCUMENTS

| | | |
|---|---|---|
| JP | 4-207406 | 7/1992 |
| JP | 10-145112 | 5/1998 |
| JP | 2000-196341 | 7/2000 |
| JP | 2000-201014 | 7/2000 |
| JP | 2001-28506 | 1/2001 |
| JP | 2003-347835 | 12/2003 |
| JP | 2005-051572 A | 2/2005 |

OTHER PUBLICATIONS

Pringle et al., "A Reconfigurable Aperture Antenna Based on Switched Links Between Electrically Small Metallic Patches", IEEE Transactions on Antennas and Propagation, vol. 52, No. 6, Jun. 2004, pp. 1434-1445.

* cited by examiner

*Primary Examiner*—Shih-Chao Chen
(74) *Attorney, Agent, or Firm*—McDermott Will & Emery LLP

(57) ABSTRACT

In a radio-frequency device in which a dielectric layer, a first conductive layer and a second conductive layer are stacked one on another, the second conductive layer is including a plurality of conductive elements which are arrayed periodically and independently of one another at a specified array pitch, and a plurality of connecting elements for electrically connecting a plurality of mutually neighboring ones of the conductive elements to each other. The connection by the connecting elements is selectively made, thus making it possible to control radiation directivity of an electromagnetic field formed by the first and second conductive layers.

10 Claims, 20 Drawing Sheets

Fig. 19A - PRIOR ART
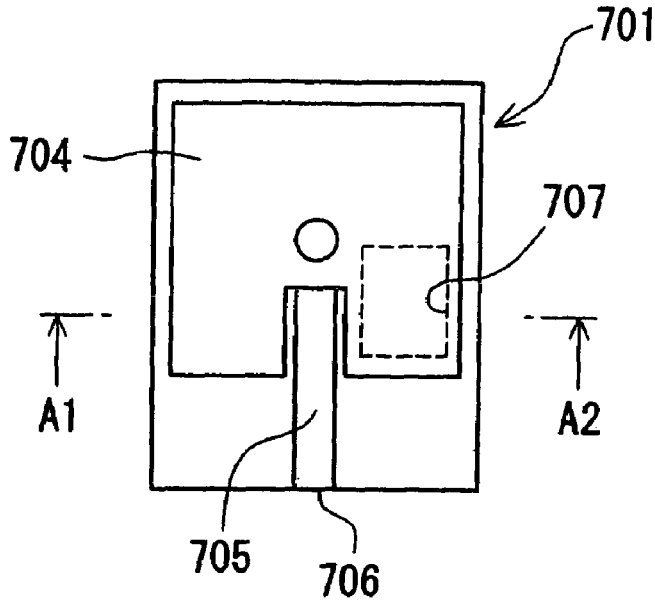
Fig. 19B - PRIOR ART
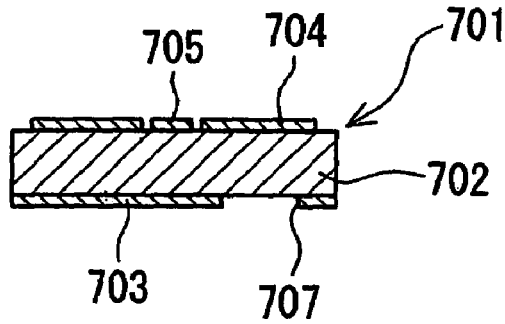

RADIO-FREQUENCY DEVICE

This Application is a continuation of International Application No. PCT/JP2005/012490, whose international filing date is Jul. 6, 2005, which in turn claims the benefit of Japanese Application No. 2004-200307, filed Jul. 7, 2004, the disclosures of which Applications are incorporated by reference herein. The benefit of the filing and priority dates of the International and Japanese Applications is respectfully requested.

BACKGROUND OF THE INVENTION

1. Field of the Invention

The present invention relates to a radio-frequency device to be used in an apparatus using radio-frequency electromagnetic waves such as microwaves or millimeter waves.

2. Description of the Related Art

It is known that a slot provided in a grounding conductor serves as an antenna equivalent to an electric dipole to radiate electromagnetic waves. By virtue of its low posture and simple structure, the slot can be utilized for electromagnetic coupling between multilayer boards, power feed to a radiator, or the like, thus lending itself to, for example, radio-frequency circuits in radio devices for use of communications.

Meanwhile, there has been a prior art in which the slot is used in combination with an existing antenna technique to modify antenna characteristics as shown in, for example, Japanese unexamined patent publication No. 2000-196341 A. The outline of the technique described in this document is explained with reference to FIGS. 19A and 19B.

As shown in FIGS. 19A and 19B, this technique relates to a microstrip patch antenna 701 in which a patch 704 formed of a conductor is placed on one surface of a dielectric substrate 702, a grounding layer 703 similarly formed of a conductor is placed on the other surface, and further a power feed line 705 for electrically connecting the patch 704 and a feeding point 706 to each other are formed. Also in this microstrip patch antenna 701, as shown in FIGS. 19A and 19B, a slot 707, which is a cutout portion, is provided in the grounding layer 703, and the slot 707 is placed asymmetrically with respect to a center of the grounding layer 703 so that the balance of a feedback current is collapsed to generate a current of a common mode with a view to achieving non-directionality and broad frequency band of antenna characteristics. It is noted that FIG. 19A is a schematic plan view of the patch antenna 701, and FIG. 19B is a schematic sectional view taken along the line A1–A2 of the patch antenna 701 of FIG. 19A.

SUMMARY OF THE INVENTION

In a conventional patch antenna using such a microstrip line structure as shown above, the resonance frequency, mode, radiation Q and degrees of coupling with the power feed line of the slot formed in the grounding layer line are determined by the shape, dimensions and positional relation with the power feed line of the slot. Therefore, in the conventional slot design, there is a need for preparatorily determining the shape, position and the like of the slot in accordance with specifications by theoretical calculation. With such a design method, indeed the slot feeds power from the microstrip line having stable transmission characteristics over a broad band, but there is a problem that it is difficult to change the resonance frequency, degree of coupling with the power feed line and the like according to changes in conditions of use or the like after the preparation of the board, i.e., after the preparation of a basic structure of the antenna.

Also, the patch antenna 701 of the structure shown in FIGS. 19A and 19B is a technique that the control of radiation characteristics and the like is enabled by forming the slot 707 at a proper position in the grounding layer 703. In such a structure, since the shapes and positional relation of the slot 707 and the patch 704 are invariable, there is a problem that it is difficult to change parameters of those shapes and positions after the preparation of the basic structure of the board.

Meanwhile, there have been available techniques for controlling antenna characteristics by freely modifying the antenna configuration, including Document 1: U.S. Pat. No. 6,323,809, Fragmented Aperture Antennas and Broadband Ground Planes, and Document 2: IEEE Transactions on Antennas and Propagation, Volume 52, Number 6, June 2004, pp. 1434 (A Reconfigurable Aperture Antenna Based on Switched Links Between Electrically Small Metallic Patches).

Document 1 discloses a technique that given orthogonal grids formed by a group of straight lines parallel to any one of two orthogonally crossing coordinate axes on a plane, inside borderlines given by the individual grids are electrically conductive or nonconductive regions, which are arranged continuously, where the positions of the conductive regions are determined through a process of multistage optimization with a view to achieving targeted antenna characteristics.

Document 2 discloses a prototype example which relates to the design of an antenna having patches interconnected by switches to make the characteristics variable in a planar array of electrically small metallic patches, where the opened/closed state of the switches is determined by an optimization technique such as a genetic algorithm so as to meet specified requirements such as frequency characteristics and radiation directivity, and where field-effect transistors are used as the switches.

In either case of Documents 1 and 2 are shown (radio-frequency) device characteristics obtained by optimizing the shape of the conductive region or the opening/closing state of the switches so as to meet desired characteristics. However, since the relation between the configuration of the circuit formed by the optimization and the wavelengths of transmitted and received electromagnetic waves is not shown, there is no logical reason that the obtained characteristics are optimum ones. Accordingly, not only the results shown in the foregoing documents are not necessarily optimum ones, but also there are some cases where with aimed characteristics changed, the optimization of (radio-frequency) device characteristics becomes no longer achievable.

Accordingly, an object of the present invention is to provide, for solving the above-described issues, a radio-frequency device which makes it implementable to easily set or change characteristics of the device after preparation of a basic device structure, and moreover which allows the optimization of the characteristics to be effectively achieved.

Another object of the present invention is to provide an antenna device design method which allows desired radiation characteristics to be simply obtained by using the radio-frequency device that is capable of changing the device characteristics.

In order to achieve the above objects, the present invention has the following constitutions.

According to a first aspect of the present invention, there is provided a radio-frequency device comprising:

a planar dielectric layer;

a first conductive layer placed on one surface of the dielectric layer; and a second conductive layer placed on the other surface of the dielectric layer, the first conductive layer having a width dimension equal to about ½ of an effective wavelength of a radio-frequency signal transmitted, the second conductive layer comprising:

a plurality of conductive elements which are arrayed periodically and two-dimensionally, independently of one another, at an array pitch equal to about ¼ of the effective wavelength of the radio-frequency signal; and a plurality of connecting elements for electrically connecting mutually neighboring ones of the conductive elements to each other, wherein the individual connection elements are placed so as to connect the individual neighboring conductive elements selectively, whereby radiation directivity of an electromagnetic field formed by the first and second conductive layers is controlled.

According to a second aspect of the present invention, there is provided the radio-frequency device as defined in the first aspect, wherein in the second conductive layer, the individual conductive elements are square-shaped in equal dimensions and shape and placed in a grid periodically at the array pitch on the other surface of the dielectric layer.

According to a third aspect of the present invention, there is provided the radio-frequency device as defined in the second aspect, wherein a ratio of a width dimension of each of the conductive elements to a spacing dimension between each conductive element and its neighboring conductive element is set within a range of 90/10 to 98/2.

According to a fourth aspect of the present invention, there is provided the radio-frequency device as defined in the second aspect, wherein in the second conductive layer, at least one set of the conductive elements having no mutual electrical connection by the connecting element is included, and a slot two-dimensionally surrounded by a conductor is formed in a region including a space between the one set of the conductive elements.

According to a fifth aspect of the present invention, there is provided the radio-frequency device as defined in the second aspect, wherein in the second conductive layer, the conductive element having no electrical connection with the conductive elements neighboring in four directions by the connecting elements is included, and a slot two-dimensionally surrounded by a conductor is formed in a region including spaces between the conductive element and the four conductive elements.

According to a sixth aspect of the present invention, there is provided the radio-frequency device as defined in the second aspect, wherein the conductive elements are formed in a region on the second conductive layer corresponding to a region which is surrounded by a distance of equality to the effective wavelength outside an outer peripheral end portion of the first conductive layer.

According to a seventh aspect of the present invention, there is provided the radio-frequency device as defined in the second aspect, wherein the first conductive layer is a patch portion to which the radio-frequency signal is inputted or from which the radio-frequency signal is outputted, and the radio-frequency device further includes a signal transmission line for performing transmission of the radio-frequency signal between the patch portion and external of the device.

According to an eighth aspect of the present invention, there is provided the radio-frequency device as defined in the second aspect, wherein each of the connecting elements is a conductive pattern.

According to a ninth aspect of the present invention, there is provided the radio-frequency device as defined in the second aspect, wherein each of the connecting elements is a chip capacitor.

According to a tenth aspect of the present invention, there is provided a radio-frequency device comprising:

a planar dielectric layer;

a first conductive layer placed on one surface of the dielectric layer; and a second conductive layer placed on the other surface of the dielectric layer, the first conductive layer having a width dimension equal to about ½ of an effective wavelength of a radio-frequency signal transmitted, the second conductive layer comprising:

a plurality of conductive elements each of which has a square shape of equal dimensions and shape and which are arrayed on the other surface of the dielectric layer at a specified array pitch two-dimensionally and periodically in a grid independently of one another;

a plurality of connecting elements for electrically connecting a plurality of mutually neighboring ones of the conductive elements to one another; and an open conductive element group which includes an conductive element group comprising a plurality of the conductive elements of an n-rows and n-columns array, where n is an integer of 2 or more, electrically connected to one another by a plurality of the connecting elements, the conductive element group having a generally square shape in which a one-side length is equal to about ¼ of the effective wavelength of the radio-frequency signal, and moreover having no electrical connections with the individual conductive elements placed in four directions therearound by the connecting elements, wherein a slot two-dimensionally surrounded by a conductor is formed in a region including spaces between the open conductive element group and the individual conductive elements placed therearound in the four directions, whereby radiation directivity of an electromagnetic field formed by the first and second conductive layers is controlled.

According to the radio-frequency device of the present invention, after the basic structure of the device is prepared, characteristics such as the shape and position of the slot can be easily set and changed according to the conditions of use. In particular, by preparing the device basic structure as a common structure and by subjecting the structure to simple machining, device characteristics can be set or changed to desired ones so that efficient design and manufacture for such a radio-frequency device can be fulfilled. Furthermore, by setting the array period for individual conductive elements or the space width between neighboring conductive elements to specified conditions, the optimization of device characteristics can be effectively achieved, so that a radio-frequency device having successful radiation directivity can be provided.

BRIEF DESCRIPTION OF THE DRAWINGS

These and other aspects and features of the present invention will become clear from the following description taken in conjunction with the preferred embodiments thereof with reference to the accompanying drawings, in which:

FIG. 19A is a schematic plan view showing a structure in which a slot is additionally provided in a microstrip patch antenna according to a prior art; and FIG. 19B is a schematic sectional view taken along the line A1–A2 in the microstrip patch antenna of FIG. 19A.

DETAILED DESCRIPTION OF THE PREFERRED EMBODIMENTS

Figure 1A:
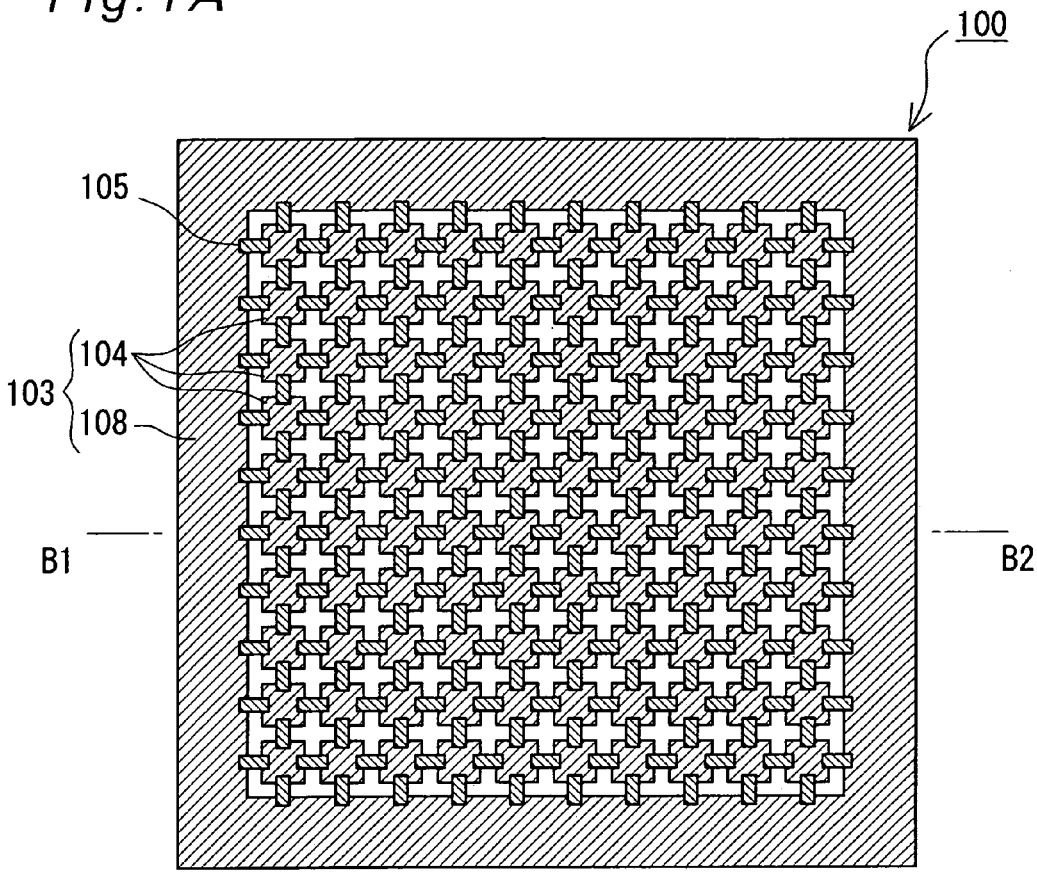
FIG. 1A is a schematic plan view of a microstrip antenna device according to an embodiment of the present invention, as viewed from the grounding conductive layer side.

Before the description of the present invention proceeds, it is to be noted that like parts are designated by like reference numerals throughout the accompanying drawings.

Hereinbelow, one embodiment of the present invention is described in detail with reference to the accompanying drawings.

Embodiment

Figure 1B:
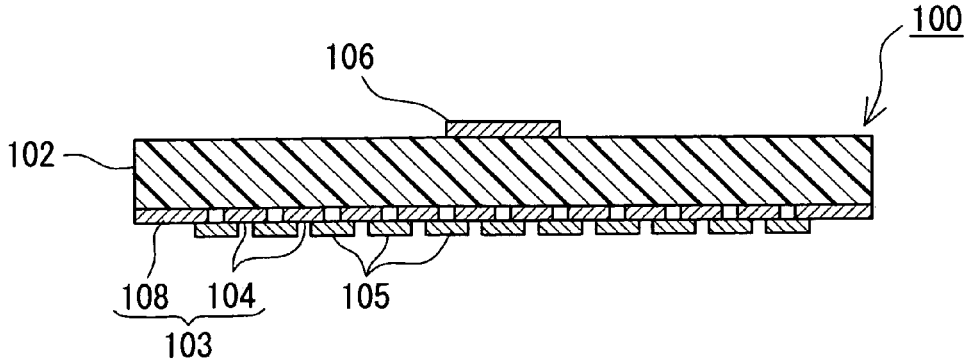
FIG. 1B is a schematic sectional view taken along the line B1–B2 in the antenna device of FIG. 1A.

FIG. 1A is a schematic plan view showing a structure of a microstrip antenna device which is an example of the radio-frequency device according to an embodiment of the present invention, and FIG. 1B is a schematic sectional view taken along the line B1–B2 in the antenna device of FIG. 1A.

As shown in FIGS. 1A and 1B, a microstrip antenna device (or antenna board) 100 (hereinafter, abbreviated as an antenna device 100), which is an antenna device adopting a microstrip line structure, includes a generally square planar dielectric layer 102, a patch portion 106 which is an example of a first conductive layer formed on one surface of the dielectric layer 102, and a grounding conductive layer 103 which is an example of a second conductive layer formed on the other surface.

As shown in FIG. 1A, which is a schematic plan view as viewed from the grounding conductive layer 103 side in the antenna device 100, the grounding conductive layer 103 includes a conductive layer peripheral portion 108 which is formed from a conductive material at a peripheral portion of the other surface of the dielectric layer 102 and which has a generally O-shape in a plan view, conductive elements (which may otherwise be conductive cells or unit conductive patterns) 104 formed from a conductive material on part of the other surface surrounded by the conductive layer peripheral portion 108, and connecting elements (or coupling elements) 105 for electrically connecting (or coupling) mutually neighboring individual conductive elements 104 to each other and for electrically connecting the conductive layer peripheral portion 108 to its neighboring individual conductive elements 104.

As shown in FIG. 1A, the conductive elements 104, which are formed in a square shape of equal dimensions and shape, are arrayed and arranged periodically with a specified array pitch and in a grid-like arrangement on the other surface of the dielectric layer 102. Also, the connecting elements 105 serve for electrical connection (or coupling) with mutually neighboring conductive elements 104 or the conductive layer peripheral portion 108 at around midpoints of the four sides of the square shape in each conductive element 104. It is noted that the connecting elements 105 are formed in a square shape of equal shape and dimensions. Since the grounding conductive layer 103 has such a construction as shown above, the whole grounding conductive layer 103, as it is seen roughly, is set into an electrically unified state, i.e. a state of being formed as one pseudo-unified conductive layer, in the state shown in FIG. 1A.

Figure 2:
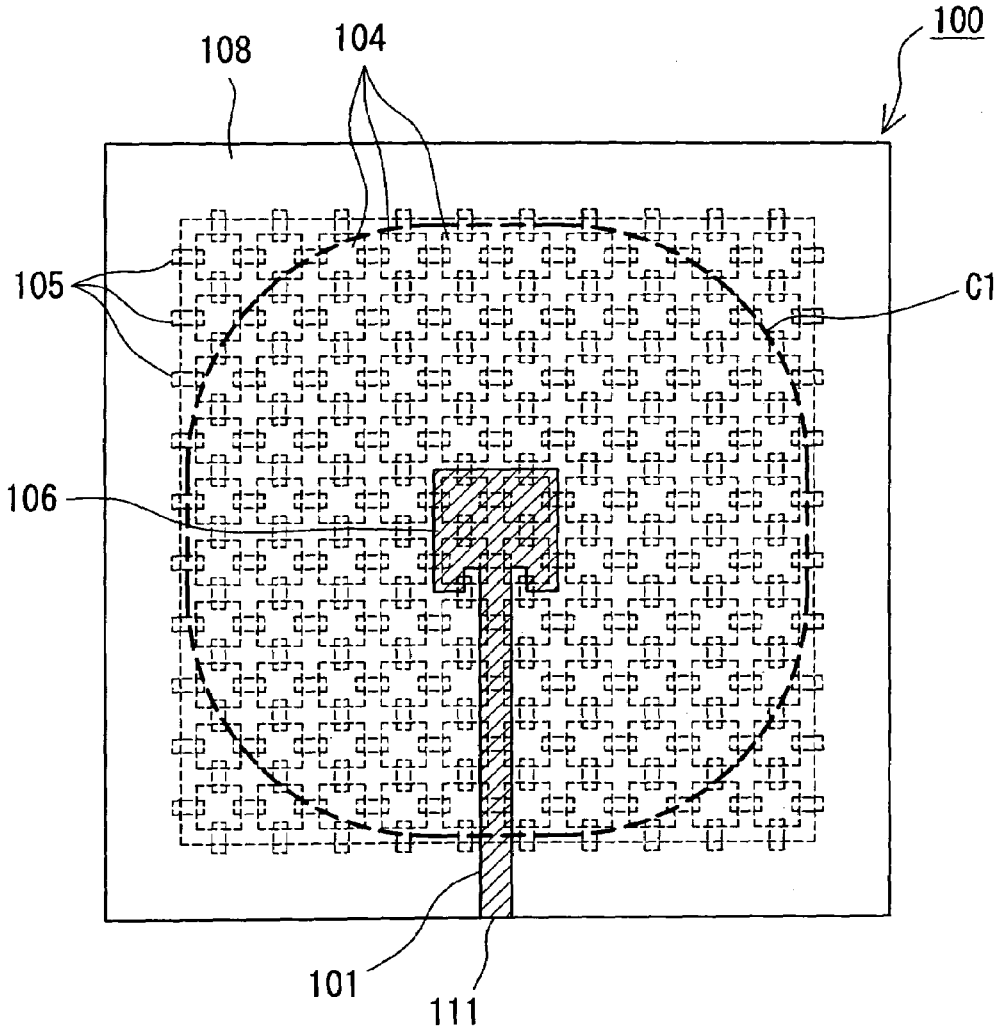
FIG. 2 is a schematic sectional view of the antenna device of FIG. 1A, as viewed from the patch portion side.

Next, FIG. 2 shows a schematic plan view of the antenna device 100, as viewed from the patch portion 106 side. As shown in FIG. 2, the patch portion 106, which is formed so as to have, for example, a square shape in a plan view, is placed at a central portion of the one surface of the dielectric layer 102, and a power feed line 101 formed of a conductive material is formed at the patch portion 106.

The antenna device 100 having such a construction as shown above, a radio-frequency signal is transmitted to the patch portion 106 from an input/output port 111, which is an end portion of the power feed line 101 shown in FIG. 2, by which the patch portion 106 and the grounding conductive layer 103 can be coupled to each other so that an electromagnetic wave that has occurred between the two members can be radiated. It is noted that the conductive layer peripheral portion 108 is not necessarily needed, but useful in cases where a region electrostatically continuous with grounding portions of external devices is needed.

Now the structure of the grounding conductive layer 103 shown above is explained in detail with reference to FIG. 12A, which is a schematic explanatory view for explaining the array of the conductive elements 104, as well as FIG. 1A. The grounding conductive layer 103 of the antenna device 100 of this embodiment adopts a structure that, for example, conductive patterns of equal shape and dimensions are arrayed as the conductive elements 104 at equal intervals in mutually orthogonal two directions, i.e. longitudinal and lateral directions, in a grid-like arrangement. More specifically, the individual conductive elements 104 are arrayed in such a fashion that directions of an E-plane and H-plane in the primary mode (TM01) of the patch portion 106 of the antenna device 100 and directions of the individual sides of the square of each conductive element 104 are identical ones.

Figure 12A:
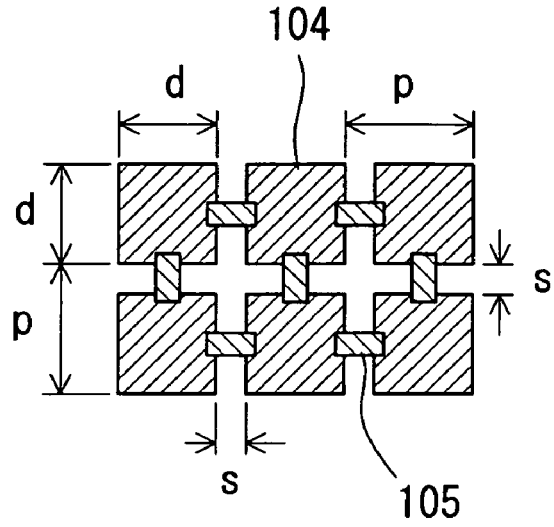
FIG. 12A is a schematic explanatory view showing array configuration and dimensions of conductive elements in a case where the grounding conductive layer is formed of square conductive elements in the microstrip antenna device of the above embodiment.

As shown in FIG. 12A, each conductive element 104 is formed so as to have a one side length 'd' of its square and a space 's' between mutually neighboring conductive elements 104. Accordingly, the array pitch, i.e. longitudinal and lateral array period, in the periodic array of the conductive elements 104 is p, that is (p=d+s). In such a case where single patterns are arrayed two-dimensionally and periodically with equal dimensions and shape, the array period needs to be not more than one quarter of a wavelength λ (i.e., effective wavelength, which is applicable hereinafter) of a transmission signal to be used. Also, the electrical connection between neighboring conductive elements 104 in this case may be given by connection between midpoints of sides of the square-patterned conductive elements 104 as shown in FIG. 12A, or by connection between vertices of the square patterns, or by other various ways of connection. Still also, the array method for square patterns may be not only such a grid-like array as described above, but also an array in which the patterns are shifted every row or column, where the conductive elements may be connected as required.

Figure 3:
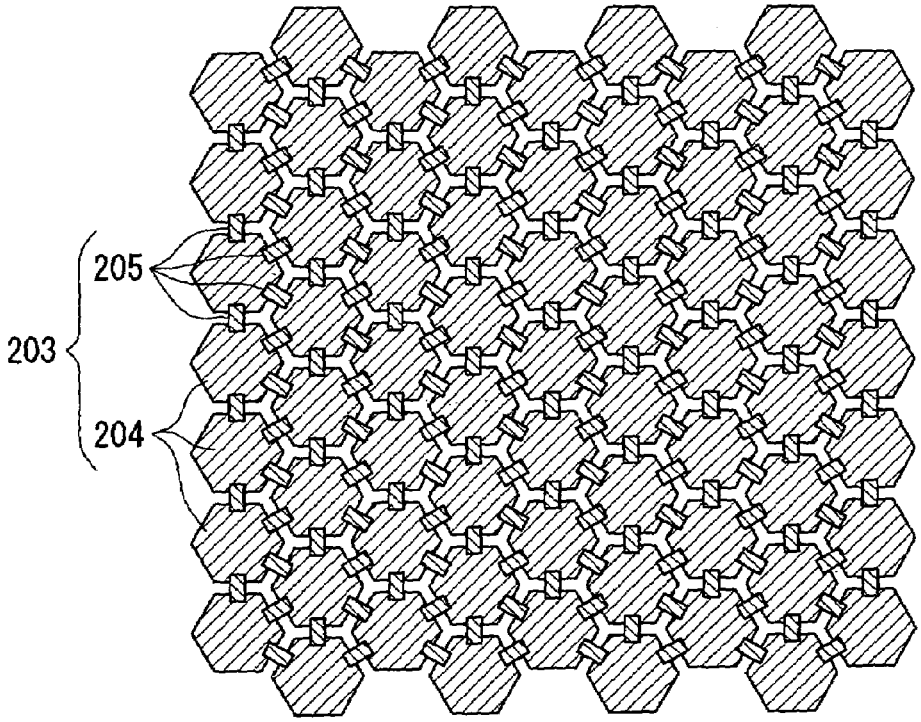
FIG. 3 is a schematic pattern view showing a configuration example of the grounding conductive layer of the radio-frequency device in a case where the conductive elements are configured in a regular hexagon in the above embodiment.

Further, the array method for the conductive elements 104 as described above (or a method in which the grounding conductive layer 103 is divided into the individual conductive elements 104) may be not a method in which each conductive element 104 is formed by a square, but instead a method in which any arbitrary regular polygon such as a rectangle, an equilateral triangle, a regular hexagon or the like is arrayed so as to fill the surface of the dielectric layer 102. As a modification example of such array methods for the conductive elements 104, FIG. 3 shows a schematic explanatory view of a grounding conductive layer 203 in a case where conductive elements 204 are formed as conductive patterns of a regular hexagon. As shown in FIG. 3, in the grounding conductive layer 203, one conductive element 204 is electrically connected with its surrounding and neighboring six conductive elements 204 by their respective connecting elements 205.

Also, although not shown, patterns having a configuration containing circular or other curved lines may also be adopted for the conductive elements, and even conductive elements having respectively different configurations can almost entirely cover the surface of the dielectric layer 102. In brief, it is the only need that the individual conductive elements can be electrically connected to one another by connecting elements. In each case of these, the conductive elements have a unique symmetry of array, so that a slot of a unique shape can be designed.

However, no matter which shape or array is adopted for the conductive elements, it is necessary that the array period of those conductive elements be not more than one quarter of a desired wavelength of the electromagnetic wave, i.e. the wavelength λ of the transmission signal to be used, in order that a radio-frequency signal is propagated at low loss. Further, in a case where conductive elements of different shapes are arrayed, an array period of conductive elements having average shape and dimensions and a variance of the array period should satisfy specified conditions.

Such conditions for the array period can be understood also from the following measurement data. As an example, with formation of a microstrip line L1 using a grounding conductive layer having patterns of the square shape formed and arrayed thereon at an array pitch of ¼λ of the transmission signal, and with formation of a simple microstrip line L2 using one planar grounding conductive layer having no patterns formed thereon unlike the microstrip line L1, a comparison between the two microstrip line was made with respect to the insertion loss of the transmission signal. In this case, in execution of transmission of a transmission signal with the array period corresponding to the ¼ wavelength, the insertion loss of the microstrip line L1 increased about 0.15 dB, as compared with the microstrip line L2 (where the line length was about 10 cm). Also, in the case of a microstrip line L3 formed at an array pitch of ⅜λ of the transmission signal under the same conditions, the insertion loss increased as much as about several dB, as compared with the microstrip line L2. With such characteristics involving a several dB increase in insertion loss as shown above, the microstrip line becomes hard to use as an antenna, so the array period is preferably set to ¼λ or less of the transmission signal. In addition, since such characteristics depend on parameters such as shape, array period, space or the like of the conductive elements constituting the grounding conductive layer, it is necessary to consider the design of the grounding conductive layer so that conditions which allow the signal in use to be transmitted can be obtained according to circumstances.

Further, with respect to a ratio of the dimensions of a conductive element 104 to its space present against a neighboring conductive element 104, the larger the ratio becomes (i.e., the larger the ratio occupied by conductor portion in the plane in which the conductive elements 104 and the spaces are present), more increase in group delay of the transmission signal can be suppressed. In addition, it is also possible to implement circuit design using this delay. With respect to a case where such group delay is not utilized positively, a desirable one of the ratio in the case where, for example, square patterns are adopted as the conductive elements 104 and where the conductive elements 104 are arrayed in a grid-like arrangement at a constant array period is described below with reference to FIG. 12A.

In the array of the conductive elements 104 shown in FIG. 12A, if a ratio of a one-side length (width dimension) 'd' of a conductive element 104 to a space width 's' from a neighboring conductive element 104 is 9:1 (i.e., 90:10) or more, then the ratio can be considered as within the permissible range because the increase in the group delay of the transmission signal with the array period 'p' of the conductive elements 104 corresponding to the ¼ wavelength can be suppressed to about 10%, as compared with boards in which the grounding conductor is an overall metallic layer. It is noted that if the ratio of the one-side length 'd' of a conductive element 104 to the space width 's' of another conductive element 104 is further reduced too small, the group delay would increase so that the use as a radio-frequency device may be hard to make. Also, in such a case as the grounding conductive layer 103 is provided with a slot so that radiation from the slot is utilized, the ratio needs to be designed to a proper value because too narrow a distance between the conductive elements would make it impossible to allow a wide aperture, causing in some cases a disadvantage in terms of radiation efficiency.

Next, the breadth of the region in which the conductive elements 104 are arrayed on the other surface of the dielectric layer 102, i.e., the region range will be described in relation to the dimensions of the patch portion 106 formed on the one surface.

First, as shown in FIG. 2, the patch portion 106 formed on the one surface of the dielectric layer 102 is formed at a central portion of the dielectric layer 102 as described above, and formed in a square shape. Further, one-side length 'd' of the square (i.e., width dimension of the patch portion 106) is set to half the wavelength λ (i.e., ½λ) of a transmission signal to be transmitted the antenna device 100. By setting the length of the patch portion 106 to such a value, resonance of the fundamental mode is excited, which leads to unidirectional radiation characteristics, allowing an easy handling of the antenna device 100. In addition, the length of the patch portion 106 needs only to be about ½λ, and also may be set as $\{(n+1)/2\}\cdot\lambda$ (where n is an integer not less than 0).

For an easier understanding of the planar placement relation between the patch portion 106, which is formed on one surface of the dielectric layer 102, and the individual conductive elements 104 formed on the other surface under the conditions as described above, individual conductive elements 104 formed on the other surface in FIG. 2 are depicted by broken line. In the planar placement relation between the patch portion 106 and the conductive elements 104 shown in FIG. 2, when power is fed through the power feed line 101 from the input/output port 111, it is undesirable that the planar distance between the slot formed in the grounding conductive layer 103 (the slot and its formation method will be described later) and the patch portion 106 is too large because their coupling becomes weaker. With the thickness of the dielectric layer 102 disregarded, since the array period for the conductive elements 104 is set to a ¼ wavelength of the transmission signal in the antenna device 100 of this embodiment, the slot is preferably formed within such a range that the distance from the outer peripheral end portion of the patch portion 106, which is the power feed element, is not more than one wavelength (i.e., not more than 1λ) of the transmission signal. In more detail, given a region C1 with which the distance becomes not more than one wavelength in FIG. 2, it is desirable, for the grounding conductive layer 103, that the conductive elements 104 are arrayed so as to allow the slot to be formed inside the region C1. By applying such a condition that the slot is formed inside the region C1, there can be provided the antenna device 100 which allows an effective use of electromagnetic coupling between resonators which are the slot and the patch portion 106.

The antenna device 100 of this embodiment shown in FIG. 2 has been described on a structure that the grounding conductive layer 103 is used as a grounding layer for the microstrip line, and the power feed line 101 and the patch portion 106 are provided on a surface of the dielectric layer 102 confronting the grounding conductive layer 103. However, the radio-frequency device of this embodiment is not limited to such a structure only. Although not shown, a structure in which a fore end of the power feed line 101 is branched plurally, a structure in which the patch portion 106 is provided plurally, and further a structure in which a plurality of power feed lines 101 are provided are also adoptable. Also, a structure of a coplanar waveguide equipped with a grounding layer or a tri-plate stripline may also be adopted. Further, a structure in which power is fed from external by means of a horn antenna is also adoptable.

Figure 14A:
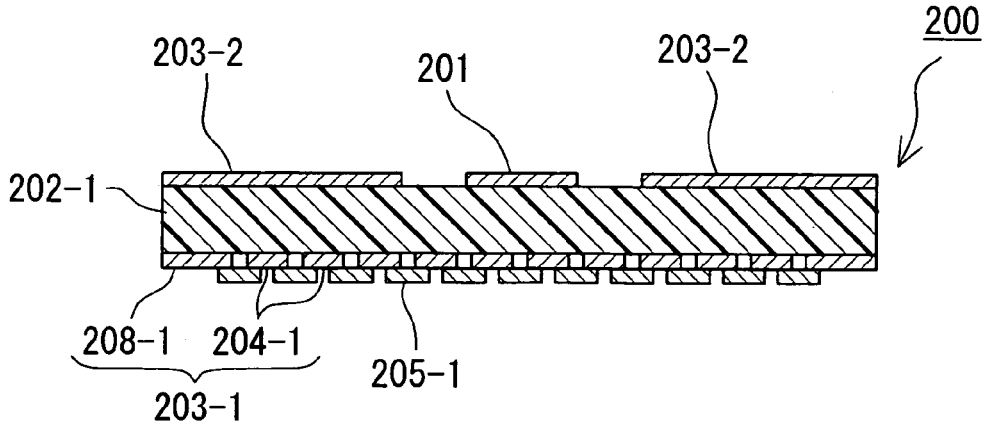
FIG. 14A is a schematic sectional view of a radio-frequency device in which power is fed by a coplanar waveguide equipped with the grounding layer in the modification example of the above embodiment.
Figure 14B:
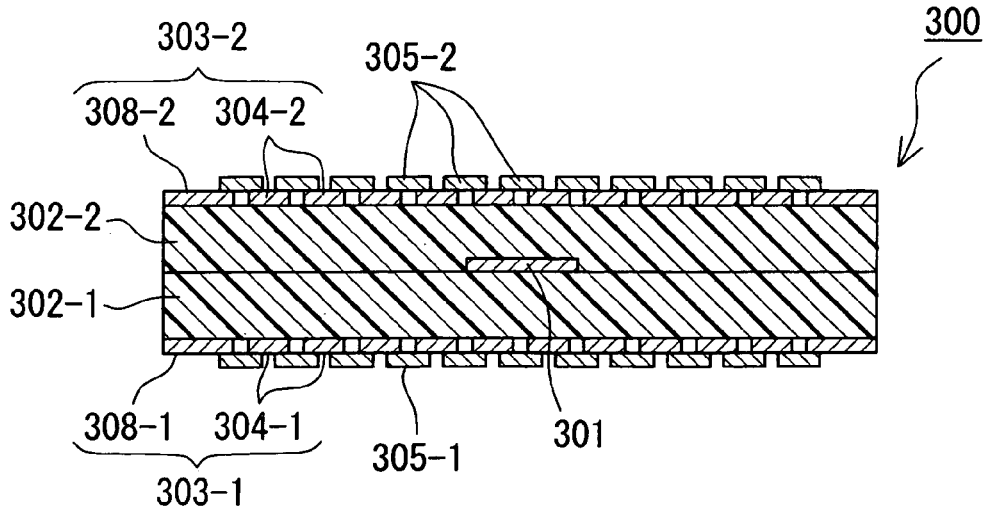
FIG. 14B is a schematic sectional view of a radio-frequency device in which power is fed by a tri-plate stripline in the modification example of the above embodiment.

Now, as a modification example of such a radio-frequency device of this embodiment as shown above, FIG. 14A shows a schematic sectional view of a radio-frequency device 200 which adopts a structure of a coplanar waveguide equipped with a grounding layer, and FIG. 14B shows a schematic sectional view of a radio-frequency device 300 which adopts a structure of the tri-plate stripline.

As shown in FIG. 14A, in the radio-frequency device 200 which adopts a structure of the coplanar waveguide equipped with the grounding layer, a grounding conductive layer 203-1 provided on one side of a dielectric layer 202-1 opposite to the surface on which a grounding layer 203-2 provided on the same surface as a central conductor 201 of the coplanar waveguide is composed of a plurality of conductive elements 204-1, connecting elements 205-1 and a conductive layer peripheral portion 208-1. In the radio-frequency device 200 of such a structure, it becomes possible to selectively radiate an electromagnetic wave toward the lower surface side via the grounding conductive layer 203-1.

Also, as shown in FIG. 14B, in a radio-frequency device 300 which adopts a structure of the tri-plate stripline, a grounding conductive layer 303-1 composed of a plurality of conductive elements 304-1, connecting elements 305-1 and a conductive layer peripheral portion 308-1 is provided on the lower surface of a first dielectric layer 302-1, as viewed in the figure, and a second dielectric layer 302-2 is stacked thereon via a power feed line 301 formed on the upper surface of the first dielectric layer 302-1, as viewed in the figure. Further, a grounding conductive layer 303-2 composed of a plurality of conductive elements 304-2, connecting elements 305-2 and a conductive layer peripheral portion 308-2 is provided on the upper surface of the second dielectric layer 302-2, as viewed in the figure. In the radio-frequency device 300 of such a structure, it is possible to radiate an electromagnetic wave toward upper and lower two surfaces via the two-layered grounding conductive layers 303-1 and 303-2.

For the dielectric layer 102 included in the antenna device 100 of this embodiment, it is desirable that a material of low dielectric loss, which is commonly used in radio-frequency circuits, is used. Although the material may be, for example, Teflon (registered trademark), ceramics, gallium arsenic or other semiconductors, glass epoxy resins or the like, yet there is a need for selecting a material to be used, depending on the dielectric loss in a frequency band to be used.

The conductive elements 104 and the conductive layer peripheral portion 108, of which the grounding conductive layer 103 is composed, are desirably formed from a good conductor material of low loss, and may be formed as conductive patterns (or metal patterns) by using, for example, copper or aluminum or the like. Further, the individual connecting elements 105 may be formed beforehand as metal patterns by using a good conductor material of low loss like the conductive elements 104, or may be given by using various types of electronic components. In the case where electronic components are used as such connecting elements 105, the electronic components need to be elements of low loss at a frequency band used. Such electronic components (elements) may be, for example, capacitors or other chip components, semiconductor elements or the like. It is also possible to use the metal patterns and the various electronic components described above in combination as the connecting elements 105. In addition, in the antenna device 100 shown in FIGS. 1A and 1B and FIG. 2, not a metal pattern but an electronic component is used as each connecting element 105.

Figure 7A:
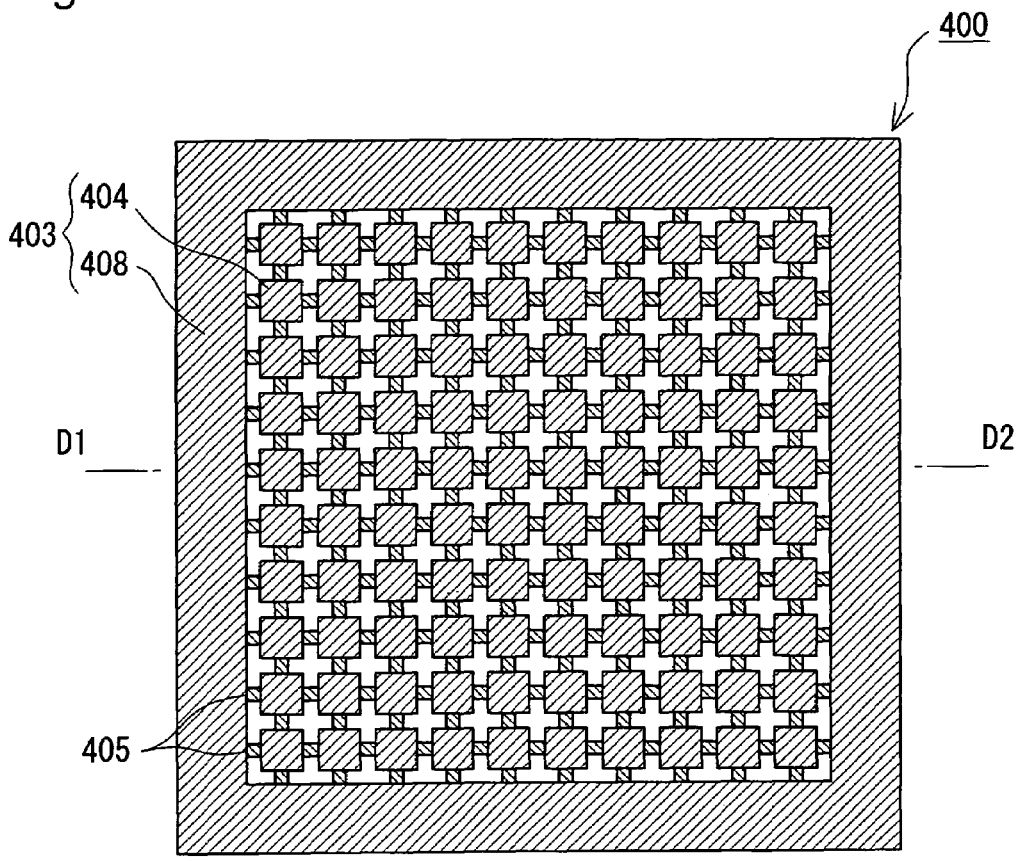
FIG. 7A is a schematic plan view showing a microstrip antenna device according to a modification example of the embodiment.
Figure 7B:
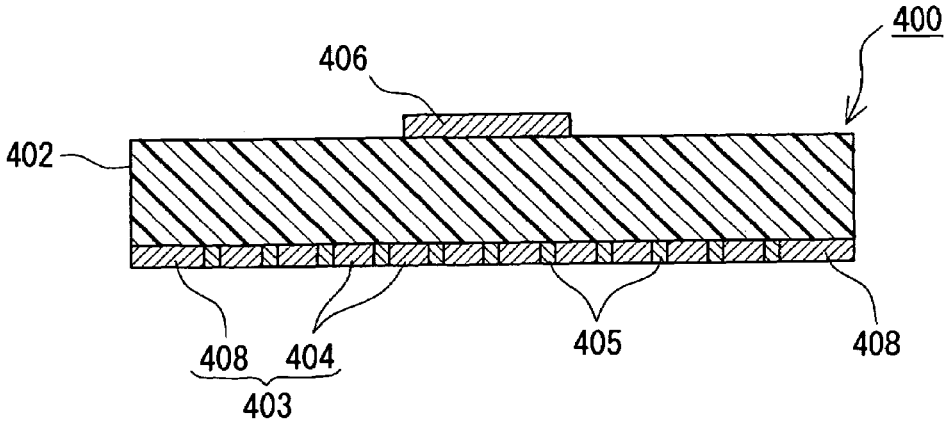
FIG. 7B is a schematic sectional view taken along the line D1–D2 in the antenna device of FIG. 7A.

Referring now to an antenna device 400 according to a modification example of this embodiment, FIG. 7A shows a schematic plan view of the device in a case where connecting elements 405 for electrically connecting individual conductive elements 404 to a grounding conductive layer 403 are formed as metal patterns, and FIG. 7B shows a schematic sectional view taken along the line D1–D2 in the antenna device 400 of FIG. 7A. As shown in FIGS. 7A and 7B, the grounding conductive layer 403 of the antenna device 400 is composed of conductive elements 404 arrayed periodically, connecting elements 405 which are given by metal patterns formed within the spaces between mutually neighboring conductive elements 404, and a conductive layer peripheral portion formed so as to surround the placement region of the conductive elements 404. In such a case where the connecting elements 405 are formed as a metal pattern like this, there are advantages that the grounding conductive layer 403 as a whole can be formed as a metal pattern and that the manufacturing process therefor can be made efficient.

Next, referring to the antenna device 100 shown in FIGS. 1A and 1B and FIG. 2, the method for forming the slot in the grounding conductive layer 103 is explained below with reference to the enlarged schematic partial plan views of the grounding conductive layer 103 shown in FIGS. 4A and 4B, FIG. 4C, FIGS. 5A, 5B and FIG. 5C.

Figure 4A:
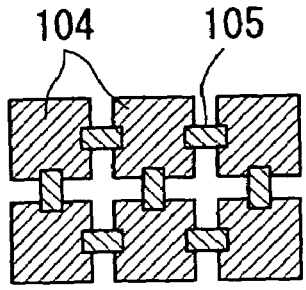
FIG. 4A is a schematic explanatory view showing conductive elements before the formation of tandem-shaped slots in the antenna device of the embodiment.
Figure 4B:
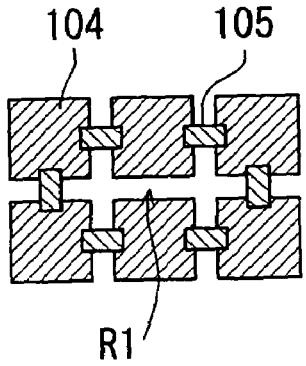
FIG. 4B is a schematic explanatory view showing a state that a connection between one pair of mutually neighboring conductive elements is released.
Figure 4C:
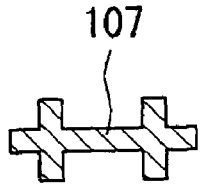
FIG. 4C is a schematic explanatory view showing a formed tandem-shaped slot.

First, FIG. 4A shows a structure in which the conductive elements 104 arrayed periodically in two rows and three columns are electrically connected to mutually neighboring conductive elements 104 by the connecting elements 105. In such a placement structure of the conductive elements 104, as shown in FIG. 4B, when one pair of mutually neighboring conductive elements 104 arrayed in a mid column are disconnected from each other (i.e., when a connecting element 105 charged with the connection is removed), a region R1 including a space present between the pair of conductive elements 104 comes to be surrounded two-dimensionally by the conductive elements 104 that are maintained in a mutual connection therearound and the connecting elements 105 charged with the connection. A region in which no conductor surrounded by conductors is placed as shown above is a slot. As shown in FIG. 4C, such a region R1 is formed as a slot 107 having, for example, a tandem shape (i.e., a tandem-shaped slot). That is, the slot 107 is so shaped that + (positive sign) shaped two regions placed in mutual adjacency and present in a state prior to the removal of the connecting elements 105 shown in FIG. 4A are connected to each other in series with the connecting elements 105 removed.

Figure 5A:
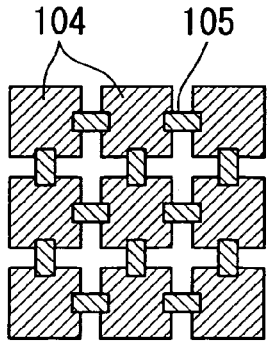
FIG. 5A is a schematic explanatory view showing conductive elements before the formation of sharp-symbol-shaped slot in the antenna device of the embodiment.
Figure 5B:
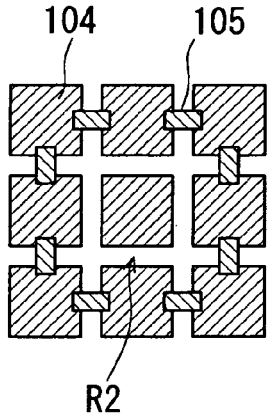
FIG. 5B is a schematic explanatory view showing a state that connections between a central conductive element and conductive elements placed on four sides of the central conductive element are released.
Figure 5C:
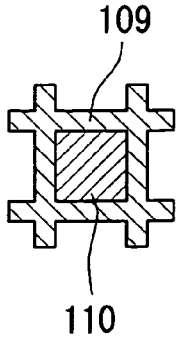
FIG. 5C is a schematic explanatory view showing a formed sharp-symbol-shaped slot.

Next, FIG. 5A shows a structure in which the conductive elements 104 arrayed periodically in three rows and three columns are electrically connected to mutually neighboring conductive elements 104 by the connecting elements 105. In such a placement structure of the conductive elements 104, as shown in FIG. 5B, when a conductive element 104 placed in the middle and mutually neighboring four conductive elements 104 placed therearound in the four directions are disconnected from each other, respectively (i.e., when the connecting elements 105 charged with the connection are removed), a region R2 including spaces present around the mid conductive element 104 comes to be surrounded two-dimensionally by the individual conductive elements 104 placed therearound in the four directions and the individual connecting elements 105 charged with their mutual connections. Such a region R2 is formed as a slot 109 (sharp-symbol-shaped slot) having a sharp-symbol shape as shown in FIG. 5C. Such a slot 109 is a slot having a shape that cross-shaped four regions arrayed in two rows and two columns and present before the removal of the connecting elements 105 as shown in FIG. 5A are mutually connected to longitudinally and laterally as a result of the removal of the connecting elements 105. In other words, the slot 109 can also be said to be a shape having a generally rectangular frame shape and having individual bump-shaped regions positioned outward at the four corner portions of the frame shape. It is noted that, in FIG. 5C, the disconnected conductive element 110 placed inside the sharp-symbol-shaped slot 109 does not directly form the slot, but defines a slot region, allowing itself to be said as an open element. In addition, the resonance frequency of such an open element 110 alone and the resonance frequency of the sharp-symbol-shaped slot 109 do not become equal to each other, but the resonance frequency of the sharp-symbol-shaped slot 109 is determined by an induced current flowing through on the open element 110.

Figure 6A:
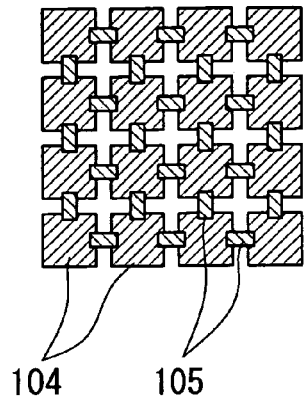
FIG. 6A is a schematic explanatory view showing conductive elements before the formation of the sharp-symbol-shaped slot in the antenna device of the embodiment.
Figure 6B:
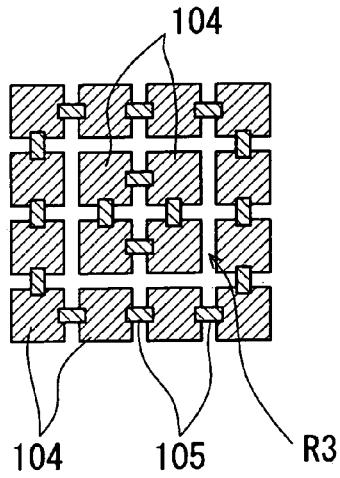
FIG. 6B is a schematic explanatory view showing a state in which connections between central four conductive elements and conductive elements placed therearound are released.

Also, such a sharp-symbol-shaped slot 109, as shown in FIGS. 5B and 5C, is not necessarily limited to those which are formed by a three-row, three-column array structure of conductive elements 104. For example, the sharp-symbol-shaped slot 109 may also be formed by using a four-row, four-column placement structure of conductive elements 104 as shown in FIG. 6A. More specifically, if the two-row, two-column four conductive elements placed at the center as shown in FIG. 6B is regarded as, for example, one conductive element 104 at the center in FIG. 5B, a region R3 including spaces therearound can be formed as a sharp-symbol-shaped slot 111. In this case, maintaining an electrical connection relation among the central four conductive elements 104 allows the four conductive elements 104 to serve as an open element group (or open conductive element group) 112. It is noted that such an open element group 112 constituting the sharp-symbol-shaped slot 111 is applicable to n-row, n-column structures larger in number than the two-row, two-column structure (where n is an integer of two or larger). In such a case, forming the open element group 112 into a generally square shape whose one side has a length of ¼ wavelength allows the sharp-symbol-shaped slot 111 to have a resonance frequency generally equal to that of the patch portion 106. Similarly, the tandem-shaped slot 107 is also applicable to two-row, m-column structures (where is an integer of three or larger) larger in number than the two-row, three-column structure. Further, with a large number of open elements formed by removing a large number of neighboring connecting elements 105 and with the formed open elements connected thereamong, an open element group formed of the connected open elements can be utilized with any arbitrary resonance frequency given thereto.

Referring now to the grounding conductive layer 103 of the antenna device 100, three methods for forming such slots 107, 109, 111 as described above are explained below.

First of all, a first method is one including the steps of forming beforehand, as connecting elements 105, metal patterns which have such dimensions and shape as to allow an easy after-processing (i.e., selective removal process) and which serve for electrical connection among individual conductive elements 104, making electrostatic connection among the conductive elements 104, thereby achieving preparation of a basic structure of the antenna device 100, and thereafter selectively removing by laser beam machining or the like the metal patterns for electrical connection (i.e., connecting elements) placed at portions where the connection between conductive elements 104 is to be disconnected. As a result of this, the slot 107 as shown in, for example, FIGS. 4B and 4C is formed at portions where the metal patterns for electrical connection have been removed.

Next, a second method is one including the steps of selectively making connection among individual conductive elements 104 by using capacitor or other chip elements as the electrical connecting elements 105 and moreover selectively suppressing the placement of the connecting elements 105 at portions where the connection between the conductive elements 104 is not given, thus forming a desired slot. In a case where chip elements are used as the connecting elements 105 like this, there is a need for taking into consideration the impedance of the chip elements depending on the frequency of the electromagnetic wave used. The dimensions of the chip elements to be used may be, for example, 1.0 mm×0.5 mm×0.5 mm or the like. Although the design of the conductive elements is limited depending on the dimensions of the chip elements, elements of the dimensions mentioned above can properly be used over a specified frequency range. Furthermore, instead of the case where selective placement of the chip elements as the connecting elements 105 is implemented as shown above, selective removal of chip elements at portions where the slot is formed may be done after the chip elements are preparatorily placed so as to provide electrical connection among all the conductive elements 104. Such selective removal of chip elements can be fulfilled by using, for example, a heat-transfer solder removing machine or by cutting of bonding wire, depending on the mounting method of the chip elements.

Then, a third method is one using an SPST (Single Pole Single Throw)—RF (Radio Frequency) switch or MEMS (Micro Electro-Mechanical System) switch or other active element as the connecting element 105 to selectively make electrical connection between the conductive elements 104. Otherwise, connection by using a PIN diode or SPDT (Single Pole Double Throw) switch is also practicable. Use of these allows, in some cases, higher frequencies, compared with the chip elements, to be used depending on the characteristics of the elements. However, an input line for control signals needs to be provided additionally.

Also, when the chip elements or active elements are used as the connecting elements 105, the usable frequency range of the resulting radio-frequency device is also limited by the usable frequency range of the elements used. Further, preparing a slot that resonates at high frequencies would involve processes related to forming the minute and precise metallic pattern in grounding conductive layer 103 and mounting the elements on the grounding conductive layer 103 in addition to the limitations for the elements. Furthermore, in either case, impedance mismatching of the electrical connecting elements 105 at the connecting portions causes return loss of transmitting signal, potentially leading to deteriorations of transmission characteristics. Therefore, it is necessary to select elements which are of low loss and which have proper input and output impedance.

Figure 12B:
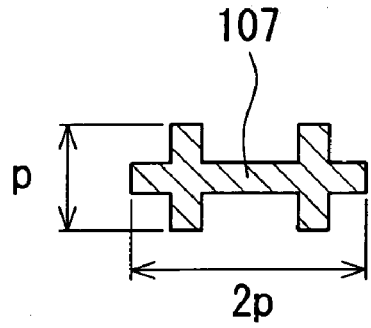
FIG. 12B is a schematic explanatory view showing shape and dimensions of a tandem-shaped slot in a case where the grounding conductive layer is formed of square conductive elements in the microstrip antenna device of the above embodiment.
Figure 12C:
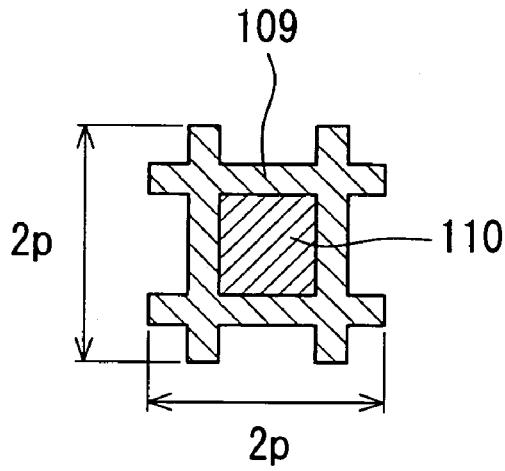
FIG. 12C is a schematic explanatory view showing array configuration and dimensions of a sharp-symbol-shaped slot in a case where the grounding conductive layer is formed of square conductive elements in the microstrip antenna device of the above embodiment.
Figure 12D:
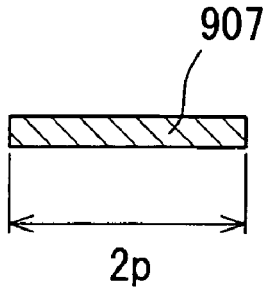
FIG. 12D is a schematic explanatory view showing shape and dimensions of a rectangular-shaped slot as a comparative example to the tandem-shaped slot of the above embodiment.

FIGS. 12B and 12C show schematic explanatory views of the relations between the array period 'p' of the conductive elements 104 and two dimensions of the slots formed by the methods shown in FIGS. 4A to 4C and FIGS. 5A to 5C. Assuming that the dimensions (especially, width dimension) of the connecting elements 105 is so small as to be negligible for the conductive elements 104, the tandem-shaped slot 107 as shown in FIG. 12B comes to have a length of its longest portion twice as large as the array period 'p' of the conductive elements 104. This slot 107, being unique in shape, has a characteristic that its resonance frequency can be lowered in comparison with a linear slot 907 (see the schematic view of FIG. 12D) whose longest portion has an equivalent length (2p).

Also, when capacitative elements such as chip capacitors are used as the connecting elements 105 between the conductive elements 104, the resonance frequency of the slot formed depends on the reactance of the electrical connecting elements 105 used. Accordingly, forming the slot by using varactor diodes or other variable capacitative elements for connection between the conductive elements 104 allows the resonance frequency of the slot to be changed by changing the coupling capacity.

In addition, as far as the electrical connecting elements 105 having sufficiently low impedance are used, using the grounding conductive layer 103 in which the square conductive elements 104 are arrayed in a grid-like arrangement allows the resonance wavelength of the tandem-shaped slot 107 formed in FIGS. 4A to 4C approximately to become equal to the wavelength of the transmission signal with its ¼ wavelength equal to the array period of the conductive elements 104. Accordingly, the slots 107, 109 formed in FIGS. 4C and 5C are enabled to excite resonance by a transmission signal that propagates along the microstrip line which is to be used with the grounding conductive layer 103 grounded.

An advantage of the structure that the square-shaped conductive elements 104 shown in FIG. 4A or FIG. 5A or the like are arrayed in a grid shape lies in that the slot 107, 109 resonated by a signal whose ¼ wavelength equals to the array period of the conductive elements 104 can be prepared by a simple process of removing one electrical connecting element 105 or removing four connecting elements 105 placed in four directions around the conductive element 104. Also, in a case where each of the conductive elements is rectangular- or regular hexagonal- or other shaped instead of being square shaped, there can also be obtained an advantage that the slot resonated by a specific frequency determined by the array period can be prepared simply as well. Further, in the case where square- and rectangular-shaped conductive elements are arrayed in a grid shape, a linear continuing slot can be prepared, thus allowing the placement design for the slots to be simplified.

Figure 6C:
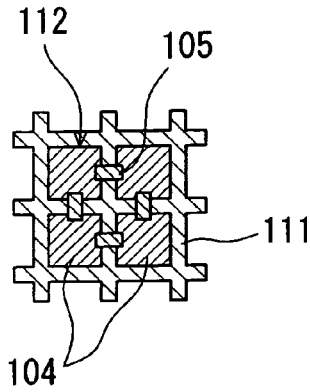
FIG. 6C is a schematic explanatory view showing a formed sharp-symbol-shaped slot.

Also, as shown in FIGS. 6A to 6C, a slot 111 formed by making a plurality of neighboring connecting elements 105 opened is considered to be lower in resonance frequency than the tandem-shaped slot 107 of FIG. 4C and the sharp-symbol-shaped slot 109 of FIG. 5C. Signals corresponding to their frequencies are longer in wavelength than a signal whose ¼ wavelength equals to the array period of the conductive elements 104, so that the signals can be propagated along the microstrip line that uses the grounding conductive layer 103 for grounding. Therefore, the slot 111 formed by opening the plurality of neighboring connecting elements 105 is enabled to excite resonance by a signal that has propagated along the microstrip line.

Although the above description has been made principally about the interaction using resonance of slots, yet the slot may also be formed in a non-resonant size and shape at the frequency of a signal transmitted so as to interact with the transmission signal.

Also, the above description has been made about structures in which conductive elements 104 of identical slot and dimensions are periodically arrayed. However, in the present invention, after the preparation of a basic structure as a radio-frequency device, placement of the electrical connecting elements 105 in the grounding conductive layer 103 is selectively controlled, by which, for example, a slot is prepared. Therefore, the individual conductive elements 104 do not need to be all identical in shape and dimensions, and moreover are not limited to cases of periodical array. An example of the cases where the conductive elements are nonuniform in shape and dimensions and moreover their array is not periodical is shown as a radio-frequency device 500 according to a modification example of this embodiment in FIG. 13, which is a schematic plan view thereof.

Figure 13:
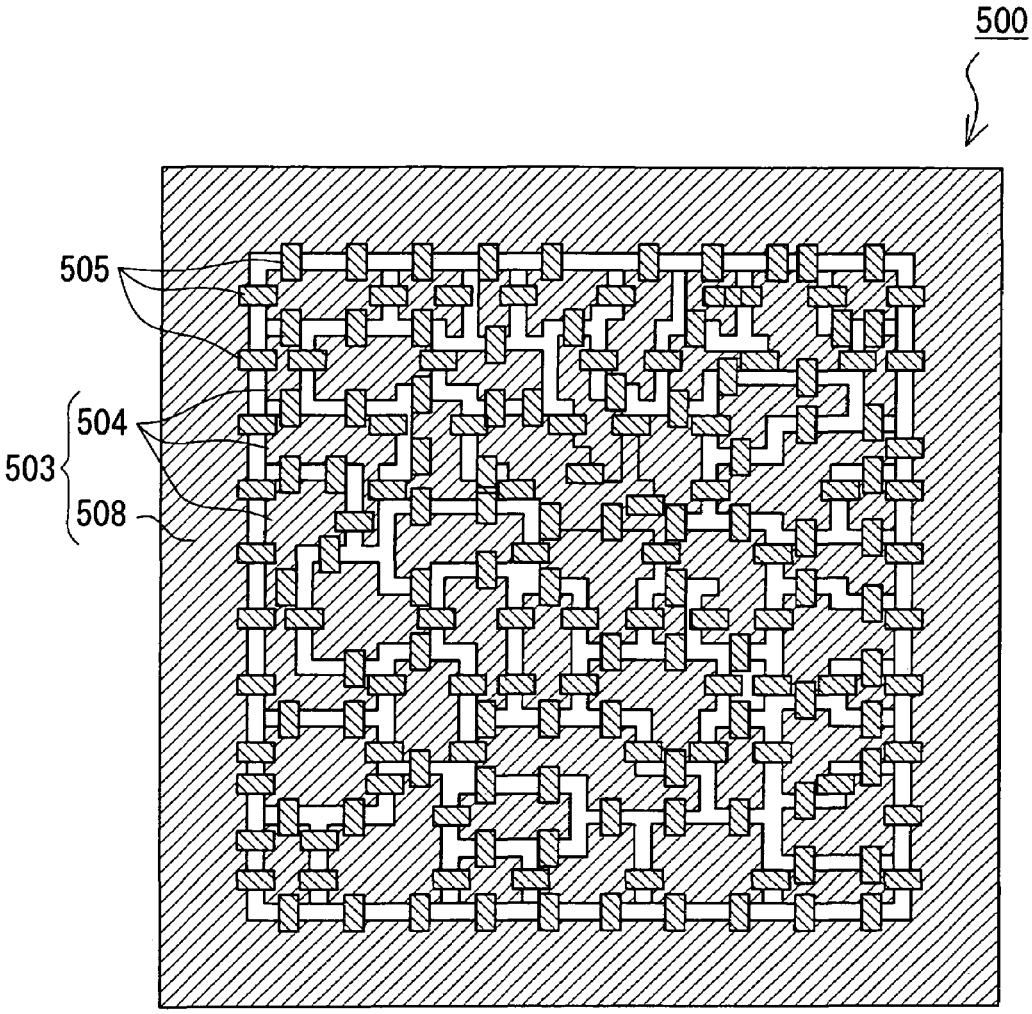
FIG. 13 is a schematic plan view showing a configuration example of the grounding conductive layer in which conductive elements of different shapes in an antenna device according to a modification example of the above embodiment.

As shown in FIG. 13, in the radio-frequency device 500, conductive elements 504 different in shape and dimensions from one another are arrayed to form a grounding conductive layer 503, and Further, the conductive elements 504 are electrically connected thereamong by connecting elements 505. Even with the radio-frequency device 500 having a structure shown in FIG. 13, there can be obtained an advantage of high degree of freedom as to the shape and position of slots that can be prepared in the grounding conductive layer 503. However, as to the frequency range of transmitted signals or the position and resonance frequency of slots that can be prepared, it is difficult to make discussions equivalent to radio-frequency devices in which such conductive elements 104 as in FIG. 1A are arrayed periodically. Thus, there is a need for performing discussions corresponding to the device each time for its use.

EXAMPLE 1

Next, examples using such structures as described above will be described. As an antenna device according to this example, one using the slot prepared in the grounding conductive layer was used, and an electromagnetic field simulation and measurement of its return loss characteristics and radiation directivity were carried out.

The antenna device of this Example 1 was formed with its dielectric layer having a dielectric constant of 2.17 and a 140 mm×140 mm×1.6 mm dimensions, with the power feed line having a line width of 5.2 mm, and with the patch portion formed of a square shape (20 mm×20 mm) that resonates in TM01 mode at 5.0 GHz even under the condition that the grounding conductive layer was given by one continuous conductive layer. In this case, the effective wavelength λ of the microstrip line is about 44 mm.

Also, in the grounding conductive layer, a conductive layer peripheral portion coupled with the external was provided in a peripheral portion, and a periodical array of 10-row, 10-column square type conductive elements was molded inside thereof. Since the conductive elements was each 9.2 mm×9.2 mm sized and had an element-to-element distance of 0.8 mm, the array period of the elements was 10 mm (10 mm=9.2 mm+0.8 mm). This is nearly one quarter of the resonance wavelength (effective wavelength λ) of the antenna device.

Figure 8A:
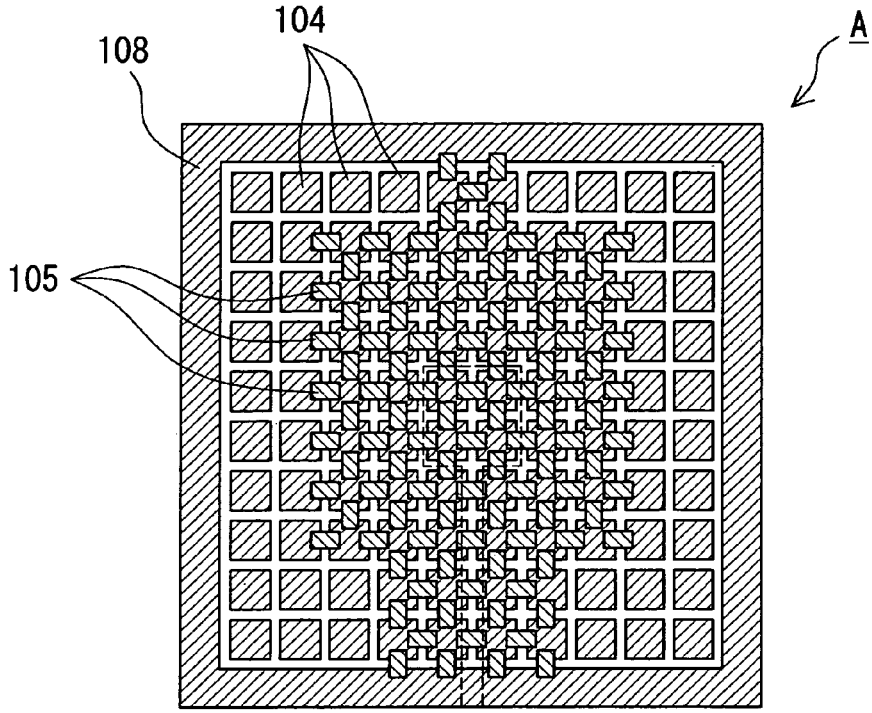
FIG. 8A is a schematic plan view of a grounding conductive layer of a microstrip antenna device according to a first example of the above embodiment, showing a case where no slots are formed.
Figure 8B:
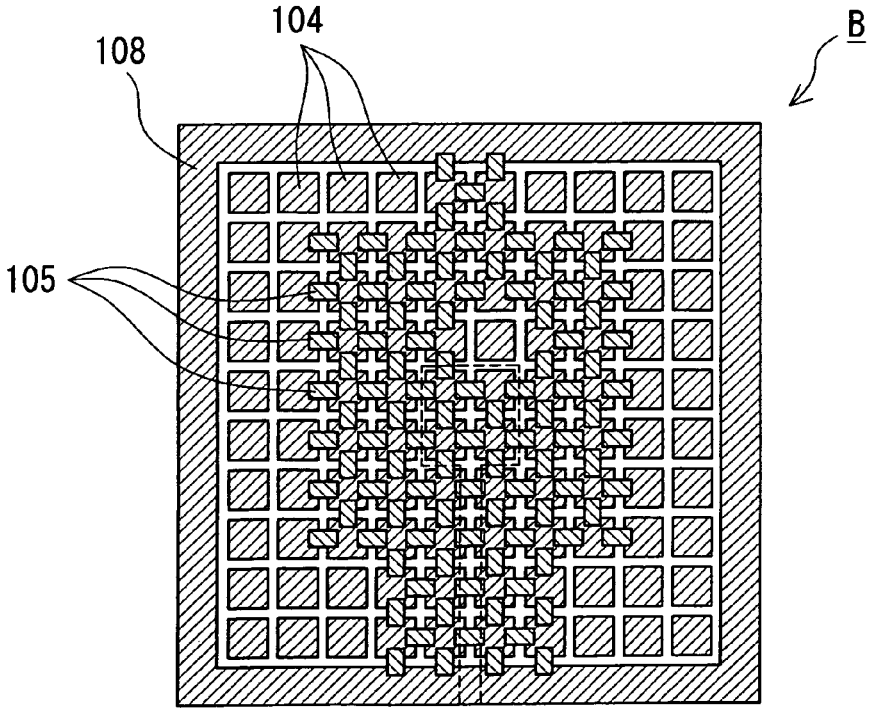
FIG. 8B is a schematic plan view of a grounding conductive layer of the antenna device of the first example, showing a case where sharp-symbol-shaped slot is formed.

The simulation and measurement were performed with one antenna device (referred to as antenna device A) in which the antenna device was electrically connected to all conductive elements of the grounding conductive layer located in a region immediately under a vicinity of the power feed line by means of connecting elements, and another antenna device (hereinafter, referred to as antenna device B) in which one open element opened from its surrounding was provided generally in the E-plane direction of the antenna device (i.e., a sharp-symbol-shaped slot was formed). Also, as the connecting elements, 1 pF chip capacitors (each of which are 1.0 mm×0.5 mm×0.5 mm) are used two in number, in parallel, by being soldered so that conductive elements were coupled to one another by midpoints of their individual sides. Schematic pattern views of their grounding conductive layers are shown in FIG. 8A (the antenna device A) and FIG. 8B (the antenna device B). In addition, in FIGS. 8A and 8B, with a view to easier understanding of structure in the antenna devices A and B, the same component parts as those used in FIGS. 1A and 1B and FIG. 2 are designated by the same reference numerals, and their description is omitted.

As a result of the simulation, the resonance frequency of the patch portion 106 alone in the fundamental mode (TM01) was 5.0 GHz on the assumption that the grounding conductive layer 103 was one continuous conductive layer. Also, in an antenna device using a grounding conductive layer which was created by connecting the individual conductive elements 104 by means of 1 pF chip capacitors with a view to setting the same conditions as in the following prototype example, the resonance frequency was 4.9 GHz. Further, in the case where the same sharp-symbol-shaped slots as in the grounding conductive layer 103 of FIG. 8B were formed in the grounding conductive layer created by connecting the individual conductive elements 104 by means of 1 pF chip capacitors with a view to evaluating the sharp-symbol-shaped slot under the same conditions as in the following prototype example, resonance was excited at a frequency of 4.8 GHz.

Figure 9A:
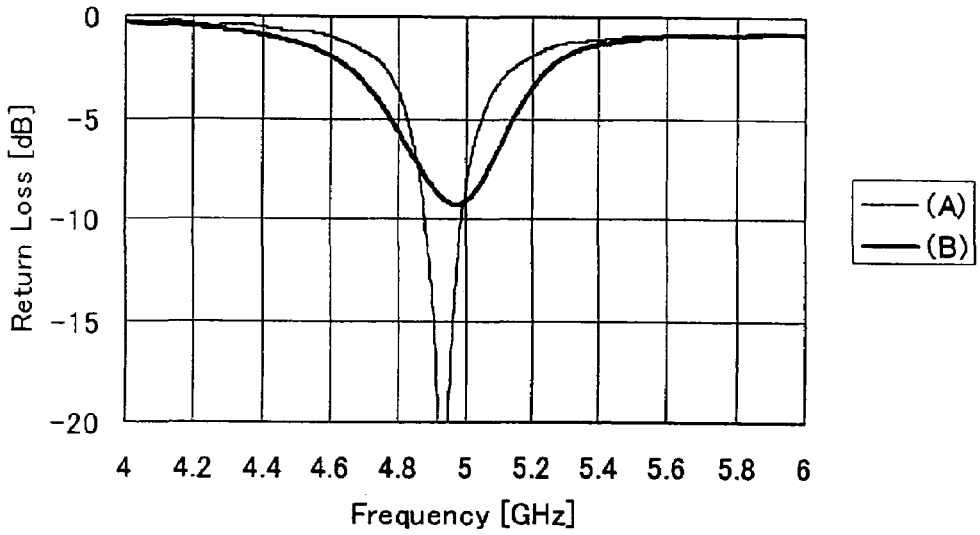
FIG. 9A is a graph showing simulation results of return loss of the microstrip antenna device of the first example in two cases where slots are not formed and where slots are formed.
Figure 9B:
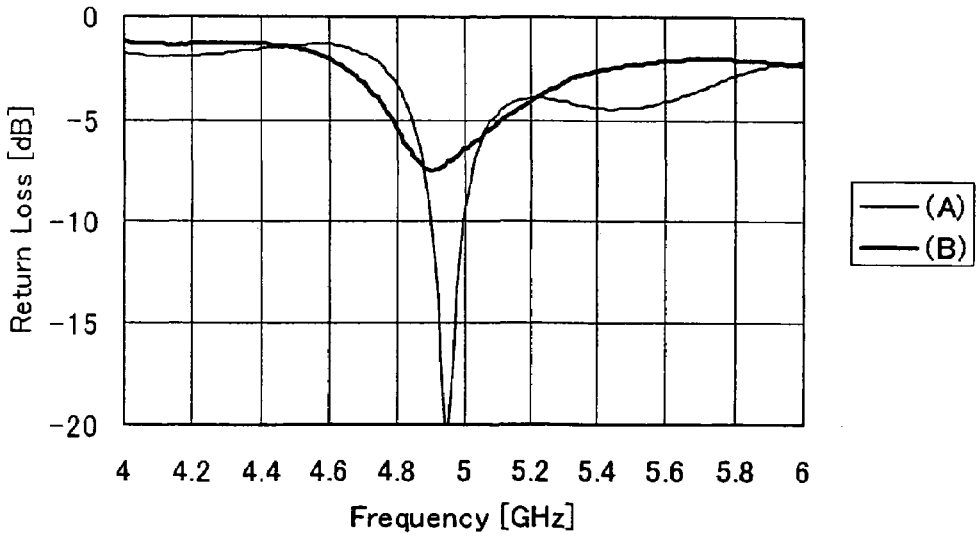
FIG. 9B is a graph showing measurement results of return loss of the microstrip antenna device in the first example in two cases where slots are not formed and where slots are formed.

With respect to the antenna devices A and B as shown above, measurement results of return losses in the simulation and measurement are shown in FIG. 9A (which shows a simulation result) and FIG. 9B (which shows a measurement result). It is noted that in FIGS. 9A and 9B, the vertical axis represents return loss (dB) and the horizontal axis represents frequency (GHz).

From FIG. 9A, which shows the simulation result, it was found that a frequency that gave a local minimum point of return loss of the antenna device B provided with the slot 109 shifted toward the higher frequency side by about 100 MHz, as compared with that of the antenna device A having no slot 109, and moreover that the bandwidth of resonance was broadened while Q lowered to a considerable extent. Also, according to FIG. 9B, which shows the measurement result, the antenna device B had its bandwidth of resonance broadened and Q lowered, as compared with the antenna device A, and moreover the frequency that gave a local minimum point of return loss shifted toward the lower frequency side. In comparison between FIGS. 9A and 9B, the antenna devices A and B, although differing from each other in the direction of resonance frequency shift, yet quite resemble each other as to how bandwidth or other resonant state changes, and the measurement result shown in FIG. 9B was able to be confirmed by the simulation result shown in FIG. 9A. From this, it was able to be confirmed that the provision of the slot leads to electromagnetic coupling between resonators which are the patch portion 106 and the slot 109, by which the state of resonance of the system changes and, as a result, the resonance frequency and the bandwidth change. In addition, differences between simulation and measurement results in resonance frequency, return loss, bandwidth or the like could be considered due to such factors as the dielectric constant of the radio-frequency device used in the experiment, differences from capacitance ideal values of elements and variations in degree of precision of mounting.

Figure 10A:
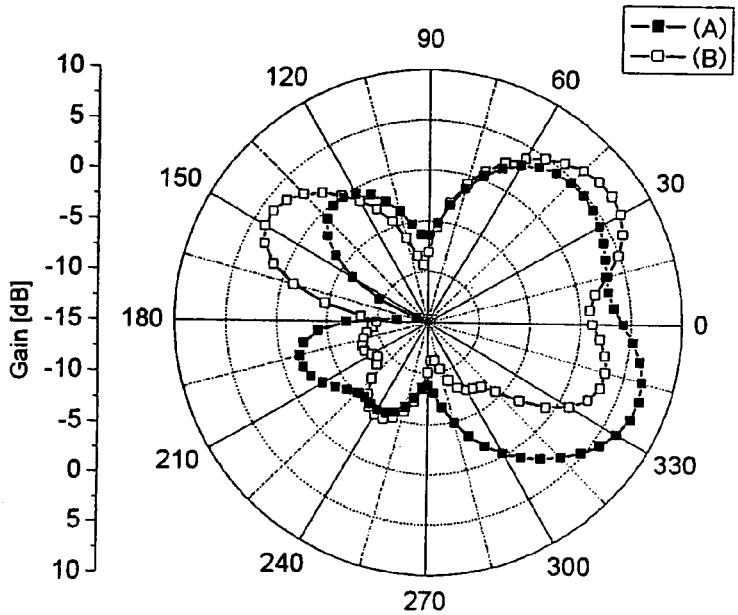
FIG. 10A is a graph showing simulation results of radiation gain at the E-plane of the microstrip antenna device of the first example in two cases where slots are not formed and where slots are formed.
Figure 10B:
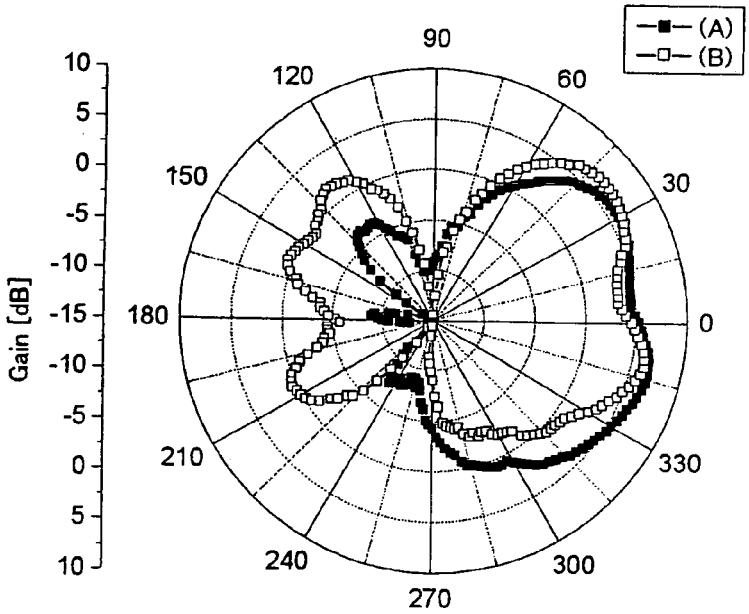
FIG. 10B is a graph showing measurement results of radiation gain at the E-plane of the microstrip antenna device of the first example in two cases where slots are not formed and where slots are formed.
Figure 11A:
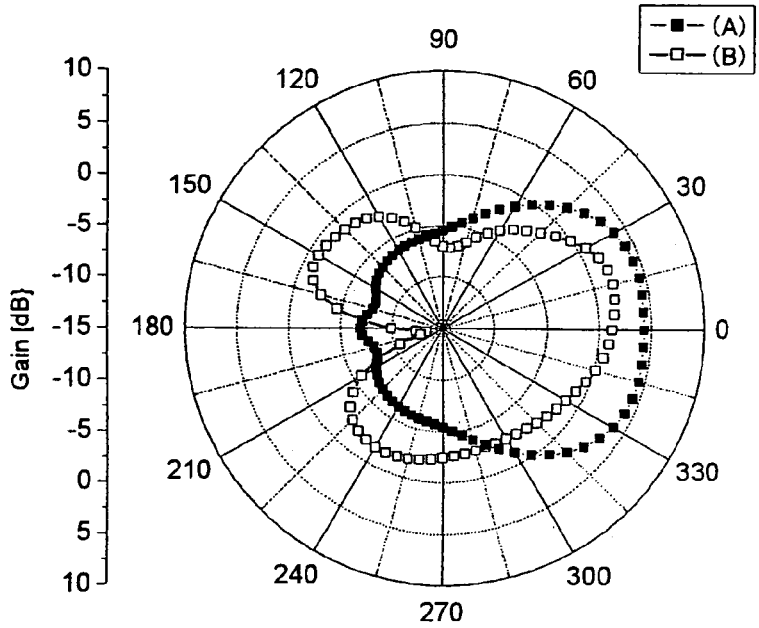
FIG. 11A is a graph showing simulation results of radiation gain at the H-plane of the microstrip antenna device of the first example in two cases where slots are not formed and where slots are formed.
Figure 11B:
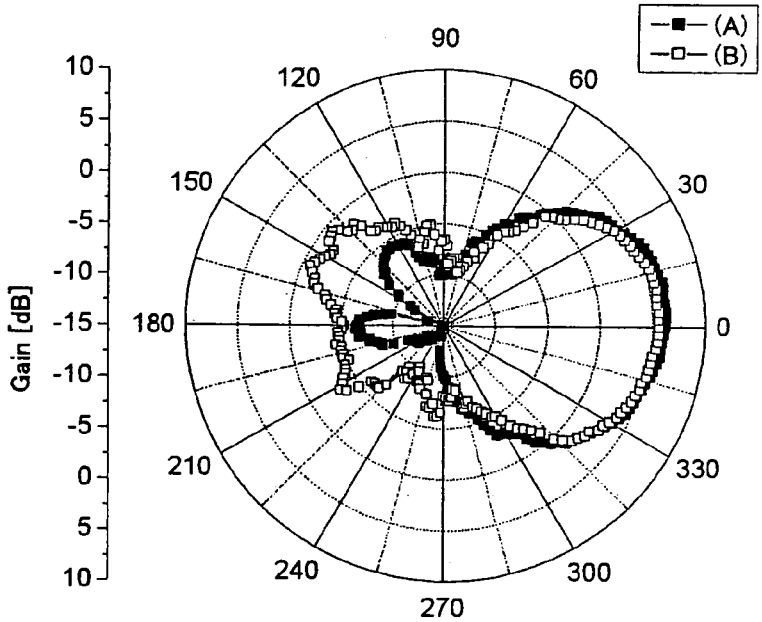
FIG. 11B is a graph showing measurement results of radiation gain at the H-plane of the microstrip antenna device of the first example in two cases where slots are not formed and where slots are formed.

Next, with respect to the antenna device A and antenna device B according to Example 1 as shown above, measurement results of radiation gain in the simulation and the measurement are shown in FIG. 10A (E-plane simulation result), FIG. 10B (E-plane measurement result), FIG. 11A (H-plane simulation result) and FIG. 11B (H-plane measurement result). It is noted here that the term "E-plane" refers to, for example, a plane orthogonal to the dielectric layer 102 in the antenna device 100 shown in FIG. 2, the plane extending along a placement direction of the power feed line 101, and the term "H-plane" refers to a plane orthogonal to the dielectric layer 102 and orthogonal to the E-plane.

In the E-plane simulation result shown in FIG. 10A, whereas the main lobe of directivity of the antenna device A is directed along an elevation angle of 345 degrees, the directivity of the antenna device B shows decreases in gain at elevation angles of 270 to 0 degrees and increases in gain at 20 to 90 degrees. The E-plane measurement result of FIG. 10B differs in beam shape from the simulation result, the main reason of which is an edge effect due to finiteness of the board shape or the like, and the above-mentioned tendency by the provision of the slot 109 is coincident with the simulation result. Further, in H-plane results shown in FIGS. 11A and 11B, the point that a directivity toward the elevation angle of 0 degrees is manifested in the upper hemisphere (upper semicircle) is common to both antenna devices A and B, but the tendency that the antenna device B manifests a stronger directivity for the lower hemisphere (lower semicircle) is coincident between simulation result and measurement result. Accordingly, it was confirmed that the provision of the slot 109 produces an effect of changing the beam directivity.

As shown above, with the use of a radio-frequency device that allows the shape of the grounding conductive layer 103 to be variable by a simple means after the preparation of a basic structure, it becomes possible to easily change such characteristics as shape and position of the slot according to changes in the environment of use. Making an antenna device by utilizing such a structure makes it possible to fulfill an antenna which allows radiation directivity or other characteristics to be easily varied to desired ones.

Next, with respect to the antenna device of this embodiment, the method of determining the space between the individual conductive elements is described below on the basis of the simulation results and measurement results on the working example.

Figure 15A:
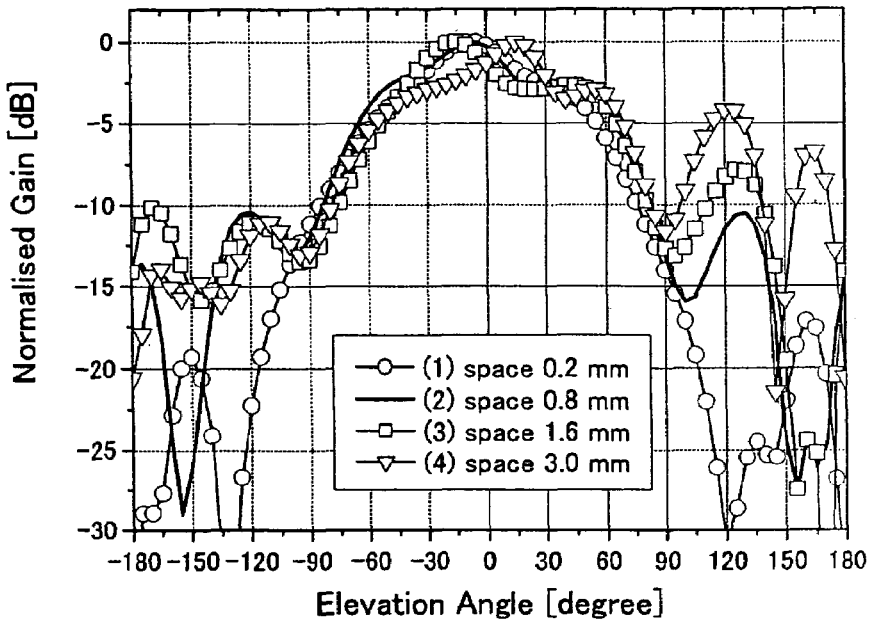
FIG. 15A is a graph showing simulation results of radiation gain at the E-plane resulting when the space between conductive elements is varied, in the microstrip antenna device according to the first example of the above embodiment.
Figure 15B:
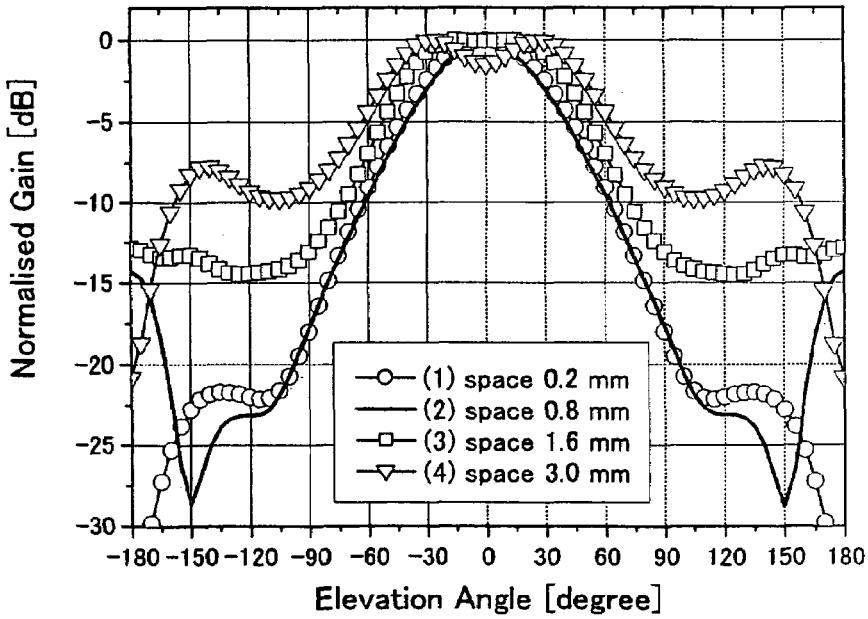
FIG. 15B is a graph showing simulation results of radiation gain at the H-plane resulting when the space between conductive elements is varied in the microstrip antenna device of the first example.

First, for example, in a case where the sharp-symbol-shaped slot 109 was not provided, FIG. 15A shows a simulation result of E-plane radiation directivity gain (which shows a gain with a maximum value normalized to 0 dB) at resonance frequencies and FIG. 15B shows a simulation result of H-plane radiation directivity gain (which shows a gain with a maximum value normalized to 0 dB), resulting under the conditions that the array period of the conductive elements 104 (array period 'p' in FIG. 12A) was fixed to 10 mm and the space between the conductive elements 104 (space width 's' in FIG. 12A) was varied. It is noted that conditions as to the shape and dimensions of the dielectric layer 102, the patch portion 106 and the like as well as the structure of the connecting elements 105 are similar to those of simulations and measurements in FIGS. 9A and 9B, FIGS. 10A and 10B, and FIGS. 11A and 11B. Further, for the space 's' between the conductive elements 104, four conditions of 0.2 mm, 0.8 mm, 1.6 mm and 3.0 mm were adopted, results of each case being shown.

With respect to the horizontal axis in FIGS. 15A and 15B, the elevation angle of 0 degrees corresponds to upward radiation (forward radiation) vertical to the dielectric layer 102 (i.e., a region of elevation angles of −90 to 90 degrees corresponds to the hemispherical direction of a solid angle of 2π toward the patch portion 106 side against the dielectric layer 102), and regions of −180 to −90 degrees and of 90 to 180 degrees correspond to downward radiation (backward radiation) toward the hemispherical direction of a solid angle of 2π directed toward the grounding conductive layer 103 against the dielectric layer 102. The backward radiation is generated from diffraction from an end portion of the dielectric layer 102 and from spaces between mutually neighboring conductive elements 104 in the grounding conductive layer 103 (non-resonant slots at measurement frequencies). As can be understood from FIGS. 15A and 15B, increasing the space between the conductive elements 104 would cause the relative gain of backward radiation to increase, where the ratio of electric power radiated forward would decrease so that the electromagnetic wave would be radiated, which is undesirable ordinarily. However, for example, when the direction of a communication partner is unknown, where the space region that can be covered by one antenna is desired to be broadened as much as possible or where forward radiation or omnidirectional radiation is desired to be switchably used, it is possible to utilize the backward radiation as described above. Further, adding a circuit for measuring the electric power at the back of the antenna makes it possible to monitor the net radiation power by measuring the backward radiation gain.

Figure 16:
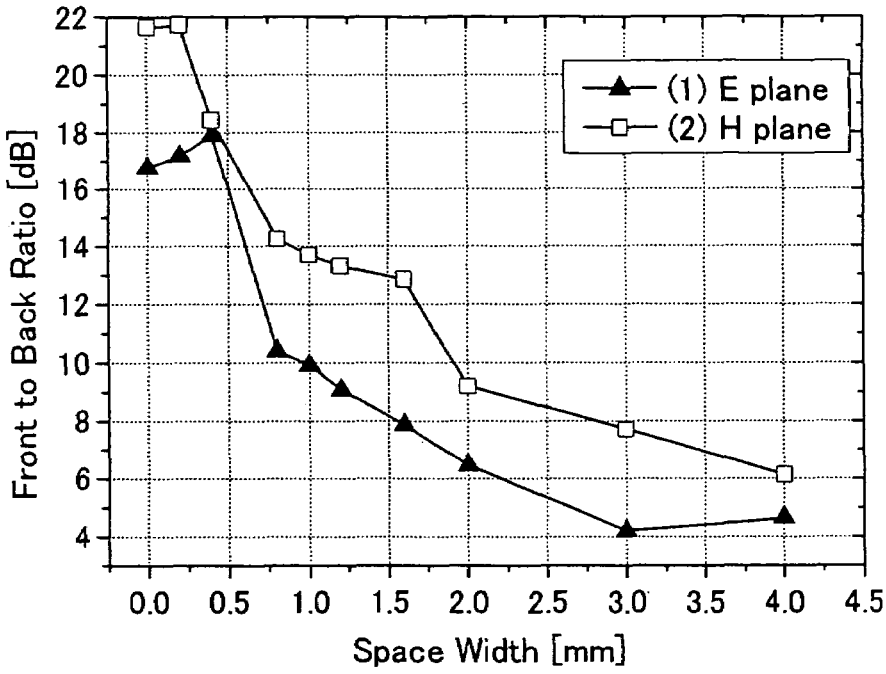
FIG. 16 is a graph showing simulation results of the ratio of forward radiation gain to backward radiation gain resulting when the space between conductive elements is varied in the microstrip antenna device of the first example.

A more detailed result is shown in FIG. 16. In FIG. 16, the horizontal axis represents the space width between the conductive elements 104 under the condition that the array period of the conductive elements 104 is fixed to 10 mm, and the vertical axis represents a ratio (F/B ratio) of a forward radiation gain in a maximum radiation direction (a gain of the main beam) to a backward radiation gain in a maximum radiation direction (a sub-beam gain within a range of back and forth 60 degrees from the elevation angle around a center which is given by a direction corresponding to an elevation angle of 180 degrees (corresponding to the rear side) from the maximum gain direction (main-beam direction) of the forward radiation) at each of the E-plane and the H-plane. This ratio, which is one of indexes showing the ratio of unnecessary radiation, shows that the relative backward radiation gain decreases with increasing value of the ratio. Any region in which the F/B ratio is not less than 10 dB is desirable because the backward radiation power becomes not more than about 10% of the total radiation power. Accordingly, from the graph of FIG. 16, it can be understood that a condition for designing an antenna having an F/B ratio of 10 dB or more is that the ratio of dimension 'd' to element space 's' of the conductive elements 104 of the grounding conductive layer 103 is 90:10 or more.

In addition, in the antenna device B of FIGS. 10A and 10B and FIGS. 11A and 11B, in which the slot (sharp-symbol-shaped slot 109 etc.) provided by opening the connecting elements 105 is so designed as to resonate with an input signal, the backward radiation increases, as compared with the antenna device A in which a resonant slot is not provided, so that the F/B ratio decreases. This aspect is explained with reference to FIGS. 17A and 17B and FIG. 18.

Figure 17A:
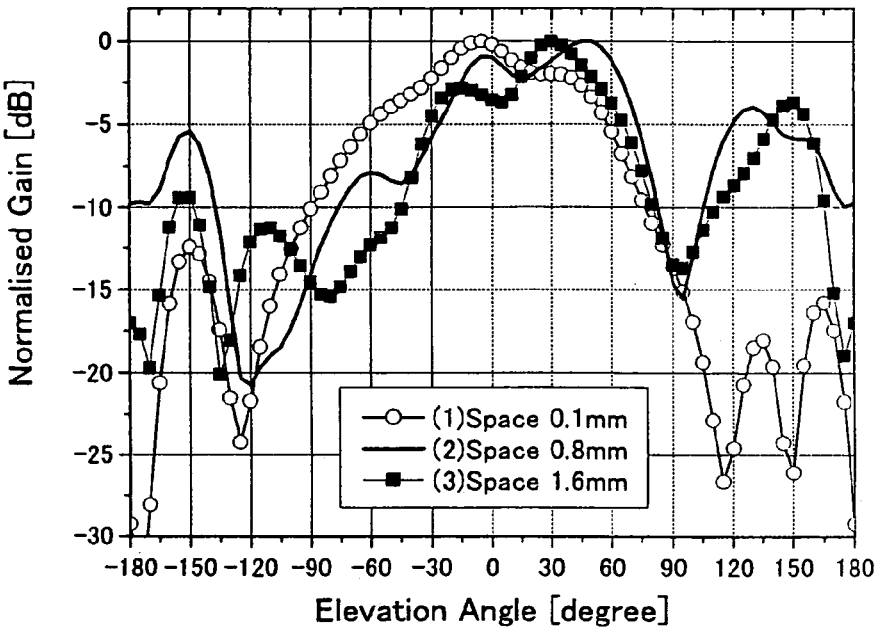
FIG. 17A is a graph showing simulation results of radiation gain at the E-plane resulting when the space between conductive elements is varied, in a case where slots are formed, in the microstrip antenna of the first example.
Figure 17B:
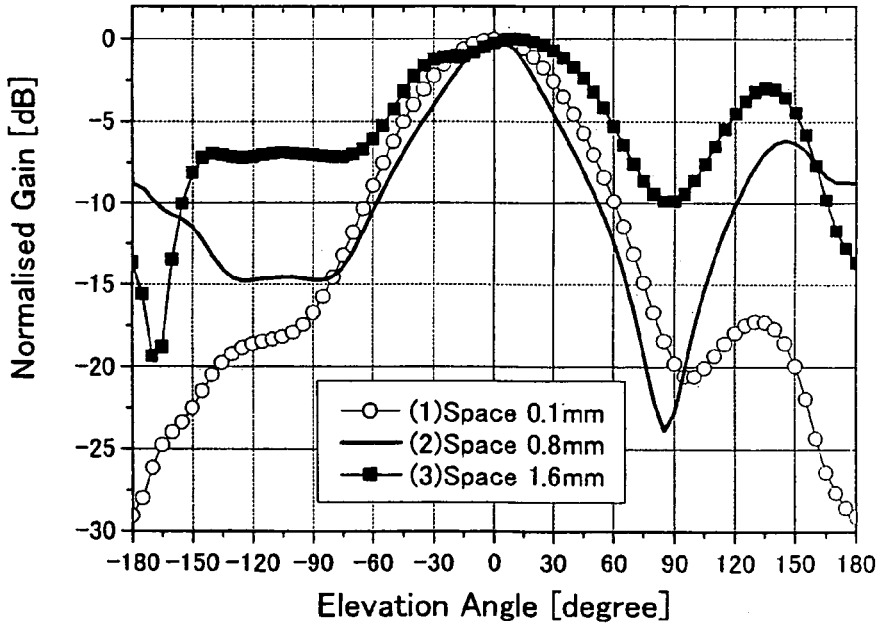
FIG. 17B is a graph showing simulation results of radiation gain at the H-plane resulting when the space between conductive elements is varied, in a case where slots are formed, in the microstrip antenna of the first example.

As same as FIGS. 15A and 15B, FIG. 17A shows a simulation result of the E-plane radiation directivity gain (which shows a gain with a maximum value normalized to 0 dB) at resonance frequencies and FIG. 17B shows a simulation result of H-plane radiation directivity gain (which shows a gain with a maximum value normalized to 0 dB), resulting under the conditions that the array period 'p' of the conductive elements 104 was fixed to 10 mm and the space 's' between the conductive elements was varied, in the case where the sharp-symbol-shaped slot 109 was provided. Conditions as to the shape and dimensions of the dielectric layer 102, the patch portion 106 and the like as well as the structure of the connecting elements 105 are similar to those of simulations and measurements in FIGS. 9A and 9B, FIGS. 10A and 10B, and FIGS. 11A and 11B. Results in three cases where the space 's' between the conductive elements 104 was 0.1 mm, 0.8 mm and 1.6 mm were shown. It is noted that what is meant by the horizontal axis of FIGS. 17A and 17B is the same as in FIGS. 15A and 15B.

As shown in FIG. 17A, the reason that setting the space width 's' between the conductive elements 104 to s=0.8 mm and s=1.6 mm cause the gain at elevation angles of 0 to 90 degrees of the E-plane to increase and the gain at elevation angles of −90 to 0 degrees to decrease is, as described hereinbefore, that the radiation directivity is changed by the electromagnetic coupling between resonators which are the antenna device and the sharp-symbol-shaped slot. Meanwhile, with the setting of s=0.1 mm, no change in the main beam direction is not seen, nearly equivalent to FIG. 15A, so that almost no changes from directivities of ordinary antenna devices are seen. Also, in the backward radiation, the gain is large in particular directions (with elevation angles of 120 to 150 degrees) at s=0.8 mm and s=1.6 mm, at which the radiation directivity changes, but the gain is low at s=0.1 mm. The radiation directivity gain of the H-plane shown in FIG. 17B also has a similar tendency in terms of backward radiation. Accordingly, unlike the case of FIGS. 15A and 15B, in which the sharp-symbol-shaped slot is not provided, it can be understood that the backward radiation gain increases when the sharp-symbol-shaped slot 109 is resonator-coupled with the patch portion 106 so that the radiation directivity changes, but the backward radiation gain is low when the electromagnetic coupling between resonators is not provided.

Figure 18:
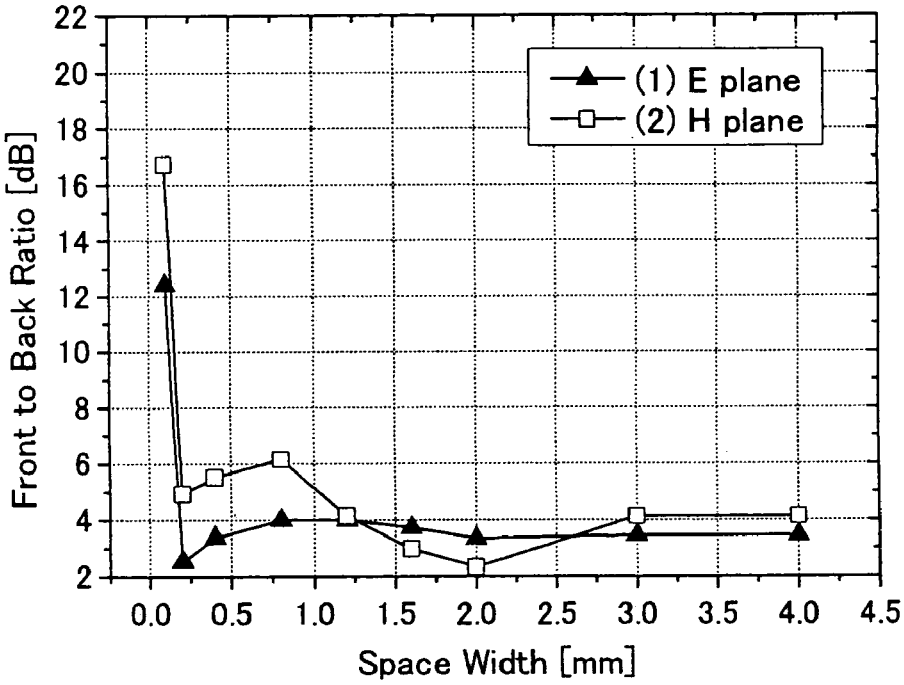
FIG. 18 is a graph showing simulation results of the ratio of forward radiation gain to backward radiation gain resulting when the space between conductive elements is varied, in a case where slots are formed, in the microstrip antenna of the first example.

A more detailed result is shown in FIG. 18. The vertical axis and the horizontal axis in FIG. 18 have the same meanings as in the graph of FIG. 16. As shown in FIG. 18, the F/B ratio is not less than 10 dB with the space between the conductive elements 104 being at 0.1 mm, but the F/B ratio becomes about 4 dB or so with the space being not less than 0.2 mm, the value of the ratio showing less changes depending on the space between the conductive elements 104. As described in the graphs of FIGS. 17A and 17B, the radiation directivity of E-plane was equivalent to that of the antenna device with the space width 's' between the conductive elements 104 being 0.1 mm, but changes in the radiation directivity of the E-plane occurred in the example in which the space between the conductive elements 104 was broadened. From these results, it can be understood that the radiation directivity changes, as it includes increases in the backward radiation gain, under the condition that the patch portion 106 and the sharp-symbol-shaped slot 109 are resonator-coupled therebetween, but changes in the radiation directivity hardly occur with the resonator coupling weakened by narrowing the space between the conductive elements 104.

Therefore, it can be said that the ratio of dimension 'd' to element space 's' of the conductive elements 104 in the grounding conductive layer 103 is preferably within a range of 90:10 to 98:2, which becomes a condition for designing an antenna that implements proper switching between a state of an ordinary antenna device having an F/B ratio of 10 dB or more and a state in which the radiation directivity has been changed toward a particular direction by placement of the sharp-symbol-shaped slot.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The radio-frequency device according to the present invention makes it possible to provide, by a simple design method, a radio-frequency device which allows characteristics of the grounding conductive layer to be changed, after preparation of a basic common structure of the device, by selective placement control over the connecting elements so that desired characteristics can be obtained.

The disclosure of Japanese Patent Application No. 2004-200307 filed on Jul. 7th, 2004, including specification, drawings, and claims are incorporated herein by reference in its entirety.

What is claimed is:

1. A radio-frequency device comprising:

a planar dielectric layer;

a first conductive layer placed on one surface of the dielectric layer; and a second conductive layer placed on the other surface of the dielectric layer, the first conductive layer having a width dimension equal to about ½ of an effective wavelength of a radio-frequency signal transmitted, the second conductive layer comprising:

a plurality of conductive elements which are arrayed periodically and two-dimensionally, independently of one another, at an array pitch equal to about ¼ of the effective wavelength of the radio-frequency signal; and a plurality of connecting elements for electrically connecting mutually neighboring ones of the conductive elements to each other, wherein the individual connection elements are placed so as to connect the individual neighboring conductive elements selectively, whereby radiation directivity of an electromagnetic field formed by the first and second conductive layers is controlled.

2. The radio-frequency device as defined in claim 1, wherein in the second conductive layer, the individual conductive elements are square-shaped in equal dimensions and shape and placed in a grid periodically at the array pitch on the other surface of the dielectric layer.

3. The radio-frequency device as defined in claim 2, wherein a ratio of a width dimension of each of the conductive elements to a spacing dimension between each conductive element and its neighboring conductive element is set within a range of 90/10 to 98/2.

4. The radio-frequency device as defined in claim 2, wherein in the second conductive layer, at least one set of the conductive elements having no mutual electrical connection by the connecting element is included, and a slot two-dimensionally surrounded by a conductor is formed in a region including a space between the one set of the conductive elements.

5. The radio-frequency device as defined in claim 2, wherein in the second conductive layer, the conductive element having no electrical connection with the conductive elements neighboring in four directions by the connecting elements is included, and a slot two-dimensionally surrounded by a conductor is formed in a region including spaces between the conductive element and the four conductive elements.

6. The radio-frequency device as defined in claim 2, wherein the conductive elements are formed in a region on the second conductive layer corresponding to a region which is surrounded by a distance of equality to the effective wavelength outside an outer peripheral end portion of the first conductive layer.

7. The radio-frequency device as defined in claim 2, wherein the first conductive layer is a patch portion to which the radio-frequency signal is inputted or from which the radio-frequency signal is outputted, and the radio-frequency device further includes a signal transmission line for performing transmission of the radio-frequency signal between the patch portion and external of the device.

8. The radio-frequency device as defined in claim 2, wherein each of the connecting elements is a conductive pattern.

9. The radio-frequency device as defined in claim 2, wherein each of the connecting elements is a chip capacitor.

10. A radio-frequency device comprising:

a planar dielectric layer;

a first conductive layer placed on one surface of the dielectric layer; and a second conductive layer placed on the other surface of the dielectric layer, the first conductive layer having a width dimension equal to about ½ of an effective wavelength of a radio-frequency signal transmitted, the second conductive layer comprising:

a plurality of conductive elements each of which has a square shape of equal dimensions and shape and which are arrayed on the other surface of the dielectric layer at a specified array pitch two-dimensionally and periodically in a grid independently of one another;

a plurality of connecting elements for electrically connecting a plurality of mutually neighboring ones of the conductive elements to one another; and an open conductive element group which includes an conductive element group comprising a plurality of the conductive elements of an n-rows and n-columns array, where n is an integer of 2 or more, electrically connected to one another by a plurality of the connecting elements, the conductive element group having a generally square shape in which a one-side length is equal to about ¼ of the effective wavelength of the radio-frequency signal, and moreover having no electrical connections with the individual conductive elements placed in four directions therearound by the connecting elements, wherein a slot two-dimensionally surrounded by a conductor is formed in a region including spaces between the open conductive element group and the individual conductive elements placed therearound in the four directions, whereby radiation directivity of an electromagnetic field formed by the first and second conductive layers is controlled.

* * * * *